US011332981B2

(12) United States Patent
Lafleur et al.

(10) Patent No.: US 11,332,981 B2
(45) Date of Patent: May 17, 2022

(54) COATED ELECTRICAL CONNECTOR BANDS AND PRESSURE COMPENSATION ASSEMBLIES FOR DOWNHOLE ELECTRICAL DISCONNECT TOOLS

(71) Applicant: Halliburton Energy Services, Inc., Houston, TX (US)

(72) Inventors: Louis Francis Lafleur, Spring, TX (US); Ravi Sharad Vayeda, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 33 days.

(21) Appl. No.: 16/944,383

(22) Filed: Jul. 31, 2020

(65) Prior Publication Data

US 2022/0034170 A1 Feb. 3, 2022

(51) Int. Cl.

| | |
|---|---|
| ***E21B 17/02*** | (2006.01) |
| ***E21B 34/06*** | (2006.01) |
| ***H01R 13/533*** | (2006.01) |
| ***H01R 13/523*** | (2006.01) |
| ***E21B 17/00*** | (2006.01) |

(52) U.S. Cl.

CPC ..... *E21B 17/028* (2013.01); *E21B 17/003* (2013.01); *E21B 17/0285* (2020.05); *E21B 34/06* (2013.01); *H01R 13/523* (2013.01); *H01R 13/533* (2013.01)

(58) Field of Classification Search

CPC .. E21B 17/003; E21B 17/028; E21B 17/0285; E21B 17/023; E21B 17/06

See application file for complete search history.

(56) References Cited

U.S. PATENT DOCUMENTS

| | | | | |
|---|---|---|---|---|
| 4,736,797 | A | 4/1988 | Restarick, Jr. et al. | |
| 5,323,853 | A | 6/1994 | Leismer et al. | |
| 5,947,198 | A | 9/1999 | McKee et al. | |
| 7,644,755 | B2 * | 1/2010 | Stoesz | E21B 17/028 166/65.1 |
| 9,803,430 | B2 | 10/2017 | Marcuccio et al. | |
| 2003/0211768 | A1 * | 11/2003 | Cameron | H01R 13/523 439/191 |
| 2004/0242044 | A1 * | 12/2004 | Head | E21B 17/028 439/190 |

(Continued)

FOREIGN PATENT DOCUMENTS

WO WO 2004/038163 A2 5/2004

OTHER PUBLICATIONS

Search Report and Written Opinion issued for International Patent Application No. PCT/US2020/044416, dated Apr. 9, 2021, 8 pages.

*Primary Examiner* — Brad Harcourt
(74) *Attorney, Agent, or Firm* — Haynes and Boone, LLP

(57) ABSTRACT

Electrically insulated connector bands for Downhole Electrical Disconnect Tools provide power and/or data communication downhole are made from metal having sufficient strength and corrosion resistance to eliminate the need of any vacuum and sealed pressure compensation assembly while being exposed to wellbore fluids. The electrical insulation is achieved by having portions of the connector bands coated with electrically insulating material. An uncoated section of each connector band will provide the electrical path between the male and female mandrels.

17 Claims, 25 Drawing Sheets

(56) References Cited

U.S. PATENT DOCUMENTS

| | | | | |
|---|---|---|---|---|
| 2009/0166087 | A1* | 7/2009 | Braden | H01R 13/533 175/40 |
| 2010/0200212 | A1 | 8/2010 | Briquet et al. | |
| 2021/0010333 | A1* | 1/2021 | El Mallawany | E21B 17/06 |

* cited by examiner

COATED ELECTRICAL CONNECTOR BANDS AND PRESSURE COMPENSATION ASSEMBLIES FOR DOWNHOLE ELECTRICAL DISCONNECT TOOLS

FIELD OF THE DISCLOSURE

The present disclosure relates generally to downhole intelligent completions and, more specifically, to coated electrical connector bands and pressure compensation assemblies for electrical disconnect tools used in intelligent completions.

BACKGROUND

Intelligent completions and electrical submersible pumps ("ESPs") are realizing greater oilfield acceptance because of their capabilities to improve recoveries, especially in multi-zone wells where production can be controlled and optimized without intervention. Previously, when ESPs had to be removed for routine maintenance, the whole completion had to be pulled, which required significant time, risk and cost.

Now, Electro-Hydraulic Disconnect Tools ("EHDTs") exist that enable ESPs to be changed out without requiring the lower intelligent completion to be removed. EHDTs allow the upper completion and all associated hydraulic and electrical control lines to be disengaged without mechanical or destructive intervention. By providing the capability to separate the completion, these disconnect tools provide a means to better control operator uncertainties and to replace completion equipment without affecting an intelligent well completion system installed downhole to control, monitor and isolate production or injection zones.

There are, however, certain disadvantages to conventional EHDTs. Conventional EHDTs use connector bands manufactured from Polyether ether ketone ("PEEK") and Stainless Steel. The PEEK portions of the connector band are used to isolate the electrical path and provide insulation between the connector band and the mating metallic components. Due to the low strength of PEEK, it must be pressure balanced to prevent cracking and tool failure. In several instances, the loss of pressure compensation has caused the PEEK to crack and short the electrical connection on the tool.

Further, some conventional connector bands contain PEEK parts that are glued together. Due to the application of heat and pressure, the glue sometimes does not hold and causes the PEEK parts to separate. In response, O-ring seals have been added between the PEEK parts to provide sealability that was otherwise provided by the glue. However, the O-rings pose yet another risk where they could take a compression set (where the O-ring or other elastomeric seals becomes permanently deformed in the compressed state) resulting in loss of sealability between the compensation chamber and wellbore. Therefore, a retention mechanism is designed to keep the glued parts in place if they separated, further adding to the complexity and cost. Also, the compensation chamber may need to be re-filled after the factory acceptance test and systems integration test which incurs additional cost and time on the tool.

DESCRIPTION OF ILLUSTRATIVE EMBODIMENTS

Figure 1:
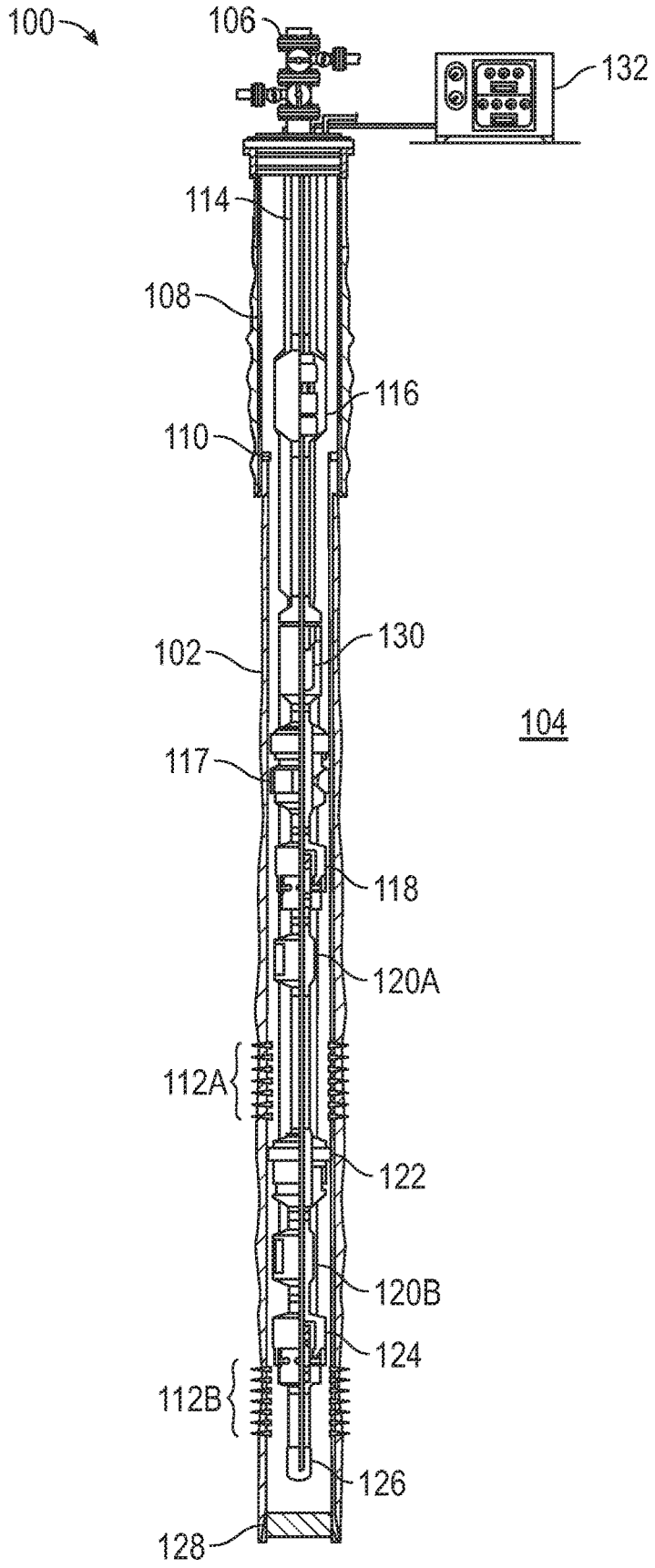
FIG. 1 illustrates a completion string, according to an illustrative application of the present disclosure.

Illustrative embodiments and related methods of the present disclosure are described below as they might be employed in an improved connector band and pressure compensation assembly for EHDTs. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

In view of the foregoing disadvantages of conventional EHDTs, the present disclosure provides electrically insulated connector bands that provide power and/or data communication downhole and associated methods of manufacturing. In general, the illustrative connector bands are made from metal having sufficient strength and corrosion resistance to eliminate the need of any pressure compensation assembly while being exposed to wellbore fluids. The electrical insulation will be achieved by having portions of the connector bands coated with electrically insulating material. An uncoated section of each connector band will provide the electrical path between the male sub and the female receptacle sub.

In a generalized illustrative embodiment, a downhole EHDT includes a female receptacle sub comprising a receptacle housing having a bore therethrough, a female electrical connector positioned along the receptacle housing, and a metallic receptacle connector band in electrical contact with the female electrical connector. The metallic receptacle connector band has a first coated section overlaid with electrically insulating material, a second uncoated section providing the electrical contact with the female electrical connector, and a third coated section overlaid with electrically insulating material, wherein the second uncoated section is positioned between the first and third coated sections.

The EHDT also includes a male sub having a male housing with a bore therethrough, a male electrical connector positioned along the male housing and a metallic male connector band in electrical contact with the male electrical connector. The metallic male connector band includes a first coated section overlaid with electrically insulating material, the first coated section of the male connector band positioned in contact with the first coated section of the receptacle connector band. A second uncoated section provides electrical contact with the male electrical connector, the second uncoated section of the male connector band positioned in contact with the second uncoated section of the receptacle connector band to provide electrical connection between the male and female electrical connectors. A third coated section is overlaid with electrically insulating material, and the third coated section of the male connector band is positioned in contact with the third coated section of the receptacle connector band.

In alternate embodiments, illustrative EHDTs are described below include various pressure compensation mechanisms.

FIG. 1 illustrates a completion string, according to an illustrative application of the present disclosure. Please note, however, a completion string is only one application of the present disclosure as the illustrative EHDTs described herein may be used in other deployments. Also, note the EHDTs described herein may not have hydraulic capability in certain illustrative embodiments (thus essentially only being an "EDT" or Electrical Disconnect Tool). Completion string 100 is deployed along a wellbore 102 previously drilled along hydrocarbon reservoir 104. Completion string 100 includes wellhead and tubing hanger 106, from which casing 108 is hung. A production liner 110 is hung from casing 108 and includes two perforations 112A and 112B from which one or more zones are produced. Production tubing 114 extends from wellhead and tubing hanger 106, extending down through wellbore 102. An ESP 116 is positioned along production tubing 114 to provide artificial lift of wellbore fluid to the surface.

A production packer 117 is positioned uphole of an interval control valve 118. Production packer 117 is used to isolate desired zones of the well. Interval control valve 118 serves to control the flow rate of fluid. Downhole gauge(s) 120A sense pressure, temperature, flow, etc. and communicates those readings to the surface. An isolation packer 122 is positioned below perforations 112A and gauges 120A. Downhole gauges 120B are positioned below isolation packer 122 and above interval control valve 124. Downhole gauges 120B also sense pressure, temperature, flow, etc. and communicate those readings to the surface. A bull plug 126 is located below interval control valve 124 and perforations 112B. A retrievable bridge plug 128 is located downhole of bull plug 126.

Still referring to FIG. 1, an EHDT 130 is positioned between ESP 116 and production packer 117. EHDT 130 is provided to disconnect the upper completion (string above EHDT 130) from the lower completion (string below EHDT 130). Hydraulic and electrical control system 132 is positioned remotely (e.g., on the surface) from EHDT 130 and controls the hydraulic and electric functions of EHDT 130.

Hydraulic and electrical control system 132 may take a variety of forms and, in alternative embodiments, may be located downhole. For example, the processing circuitry of hydraulic and electrical control system 132 may include at least one processor, a non-transitory, computer-readable memory, transceiver/network communication module, and optional I/O devices and user interface, all interconnected via a system bus. Software instructions executable by the processor for implementing the functions of the illustrative methods described herein may be stored in memory. In certain embodiments, the processing circuitry may be connected to one or more public and/or private networks via one or more appropriate network connections. It will also be recognized that the software instructions to perform the functions of the present disclosure may also be loaded into memory from a CD-ROM or other appropriate storage media via wired or wireless methods.

Moreover, those ordinarily skilled in the art will appreciate that the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

Now that one illustrative application of EHDT 130 has been shown, more details of EHDTs of the present disclosure will now be described.

Figure 2A:
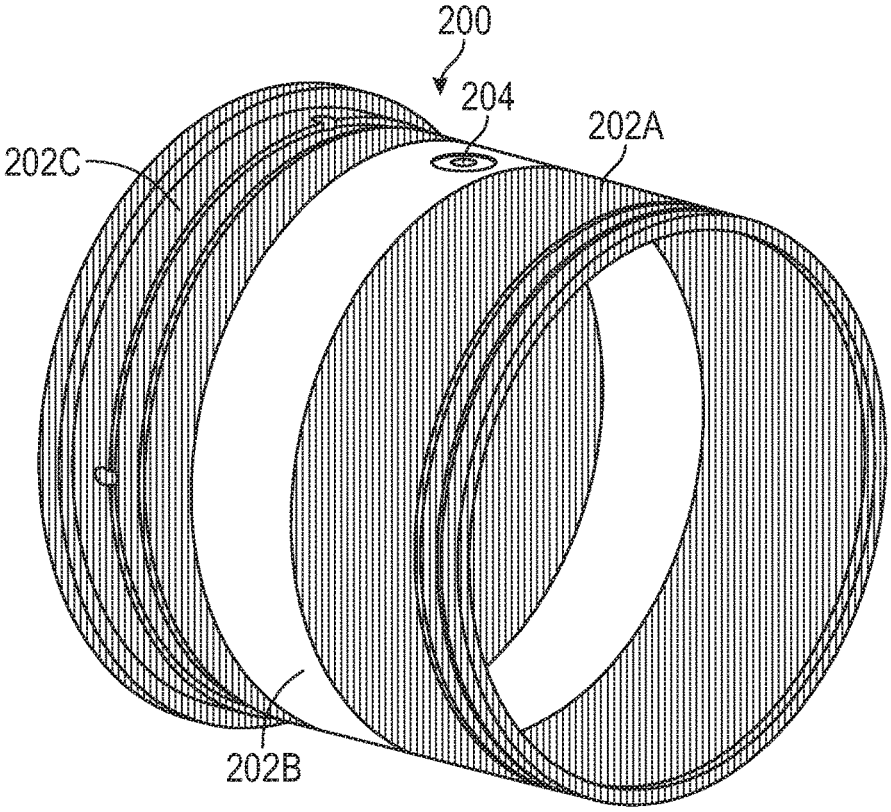
FIG. 2A is a three-dimensional view of a female receptacle connector band for an EHDT, according to certain illustrative embodiments of the present disclosure.
Figure 2B:
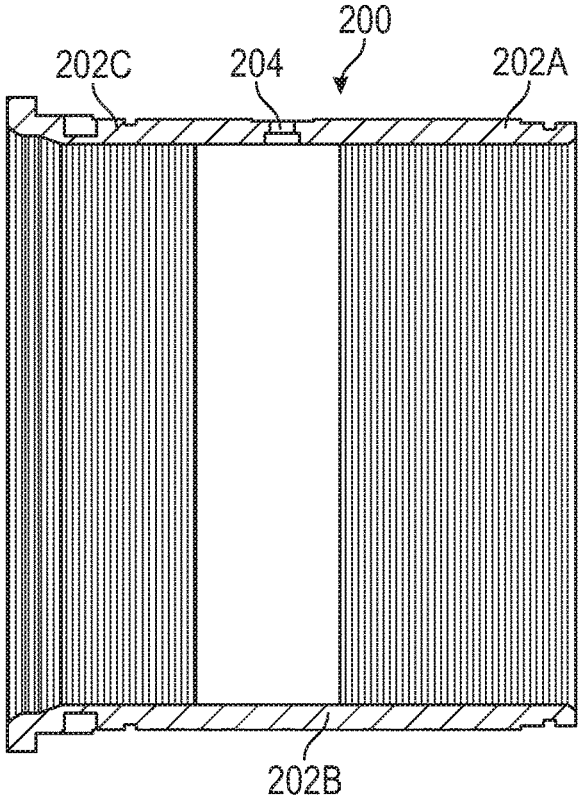
FIG. 2B is a sectional view of the female receptacle connector band of FIG. 2A.

FIG. 2A is a three-dimensional view of a female receptacle connector band for an EHDT, according to certain illustrative embodiments of the present disclosure. FIG. 2B is a sectional view of the female receptacle connector band. Female receptacle connector band 200 is a circumferential body made of an electrically conductive metallic material, such as, for example, nickel alloy, martensitic stainless steel, duplex stainless steel, super duplex stainless steel, low alloy steel. In this example, receptacle connector band 200 is made of a metal with sufficient strength to and corrosion resistance to eliminate the need for a pressure compensation assembly in the EHDT when exposed to wellbore fluids. In certain illustrative embodiments, the metal used to construct receptacle connector band 200 has a minimum yield strength range of 80,000 psi to 150,000 psi or, in other embodiments, greater than 50,000 psi. In those embodiments in which a pressure compensation assembly is not needed due to the strength of the metallic material used in band 200, the construction costs, design complexity and manufacturing time of the EHDT is greatly reduced. However, other illustrative embodiments described below will include various pressure compensation assemblies.

In this example, female receptacle connector band 200 has been manufactured as a single structure. However, in alternate embodiments, receptacle connector band 200 may be comprised of two or more parts assembled together. Receptacle connector band 200 includes a first section 202A, second section 202B and third section 202C. Each section 202A-C is a circumferential section extending all the way around band 200. First section 202A and third section 202C are coated with an electrical insulating material such as, for example, ceramic, thermosetting plastic (including micarta, G10 and similar materials), elastomeric, polymeric material or other suitable material. Second section 202B is positioned between first section 202A and third section 202C. Second section 202B is uncoated, thereby leaving the metallic body of band 200 exposed. Uncoated second section 202B provides the electrical path between female receptacle connector band 200 and the male connector band, as described below. Although not shown in this figure, uncoated second section 202B is in electrical contact with the female electrical connector which is positioned at connector port 204, as will also be further described below.

Figure 2C:
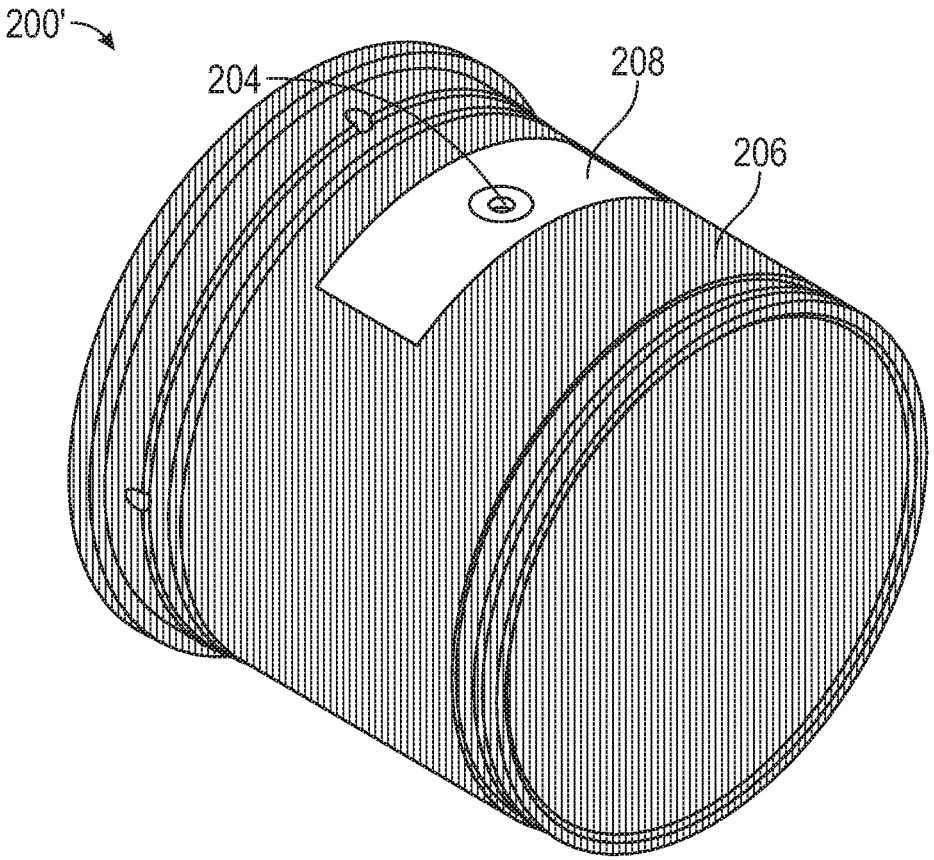
FIG. 2C is a three-dimensional view of a receptacle connector band, according to an alternative embodiment of the present disclosure.

FIG. 2C is a three-dimensional view of a receptacle connector band, according to an alternative embodiment of the present disclosure. In this example, receptacle connector band 200' is a metallic circumferential body including a body 206 that has been coated with electrical insulating material. However, a small section of receptacle connector band 200' is not coated. In this general embodiment, the majority of receptacle connector band 200' has been coated (e.g., 75-90% coated), while a small section of receptacle connector band 200' is left uncoated in order to transfer electrical/data signals with its male counterpart.

Figure 3A:
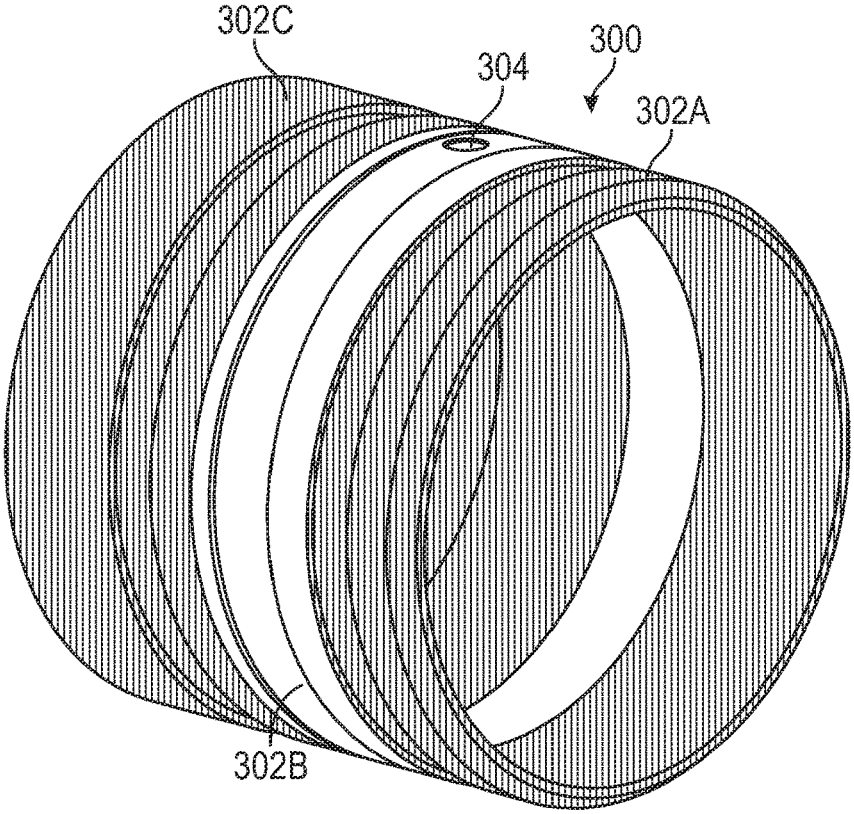
FIG. 3A is a three-dimensional view of a male connector band for an EHDT, according to certain illustrative embodiments of the present disclosure.
Figure 3B:
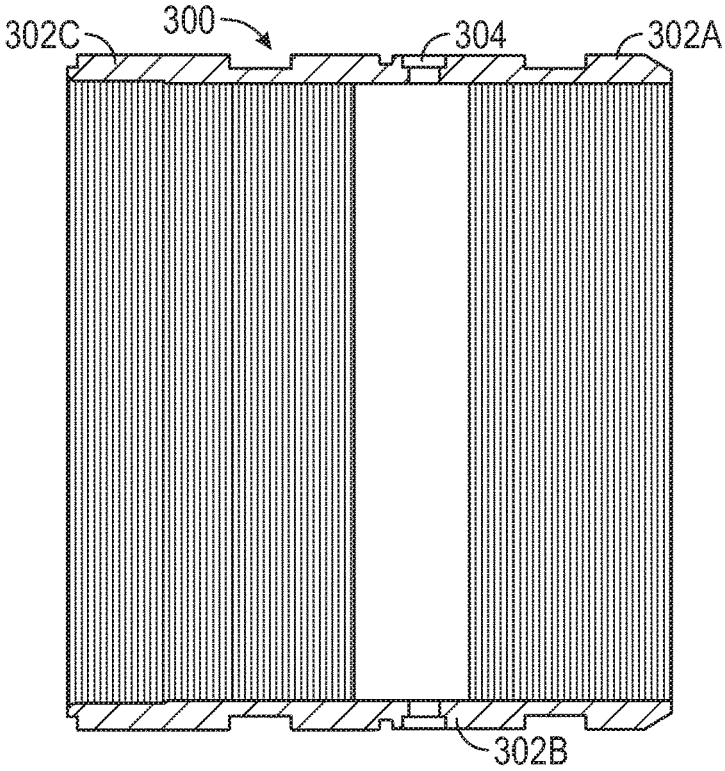
FIG. 3B is a sectional view of the male connector band of FIG. 3A.

FIG. 3A is a three-dimensional view of a male connector band for an EHDT, according to certain illustrative embodiments of the present disclosure. FIG. 3B is a sectional view of the male connector band. Male connector band 300 mates with female receptacle connector band 200 (not shown) in order to establish electrical connectivity as described herein. Male connector band 300 is also a circumferential body made of an electrically conductive metallic material, such as, for example, nickel alloy, martensitic stainless steel, duplex stainless steel, super duplex stainless steel, low alloy steel. In this example, male connector band 300 is made of a metal with sufficient strength to and corrosion resistance to eliminate the need for a pressure compensation assembly in the EHDT when exposed to wellbore fluids. In certain illustrative embodiments, the metal used to construct male connector band 300 has a strength range of 80,000 psi to 150,000 psi. In those embodiments in which a pressure compensation assembly is not needed due to the strength of the metallic material used in male connector band 300, the construction costs, design complexity and manufacturing time of the EHDT is greatly reduced. However, other illustrative embodiments described below will include various pressure compensation assemblies.

In this example, male connector band 300 has been manufactured as a single structure. However, in alternate embodiments, male connector band 300 may be comprised of two or more parts assembled together. Male connector band 300 includes a first section 302A, second section 302B and third section 302C. Each section 302A-C is a circumferential section extending all the way around band 300. First section 302A and third section 302C are coated with an electrical insulating material such as, for example, ceramic, thermosetting plastic (including micarta, G10 and similar materials), elastomeric, polymeric material or other suitable material. Second section 302B is positioned between first section 302A and third section 302C. Second section 302B is uncoated, thereby leaving the metallic body of band 300 exposed. When bands 200 and 300 are mated to one another, their respective sections mate with one another where uncoated second section 302B provides the electrical path with uncoated second section 202B of connector band 200. Although not shown in this figure, uncoated second section 302B is in electrical contact with the male electrical connector which is positioned at connector port 304, as will also be further described below.

Figure 3C:
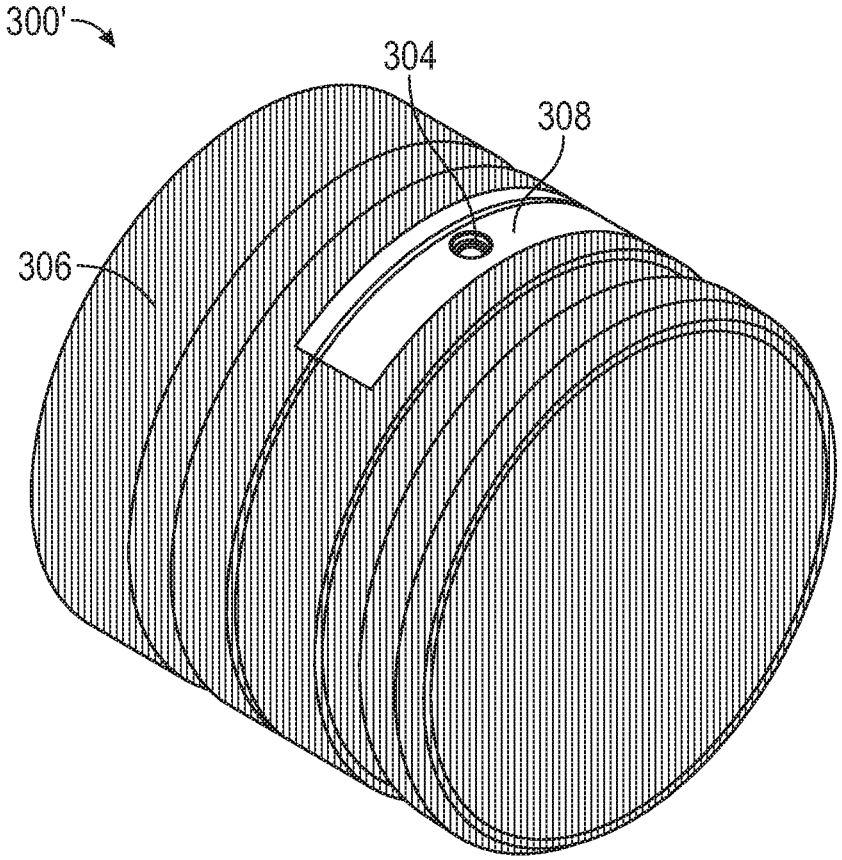
FIG. 3C is a three-dimensional view of a male connector band, according to an alternative embodiment of the present disclosure.

FIG. 3C is a three-dimensional view of a male connector band, according to an alternative embodiment of the present disclosure. In this example, male connector band 300' is a metallic circumferential body including a body 306 that has been coated with electrical insulating material. However, a small section of male connector band 300' is not coated. In this general embodiment, the majority of male connector band 300' has been coated (e.g., 75-90% coated), while a small section of male connector band 300' is left uncoated in order to transfer electrical/data signals with its female counterpart.

The various embodiments of the connector bands can be combined together. For example, male connector band 300 may be combined with receptacle connector band 200' or vice versa. However, in those embodiments when male connector band 300' is combined with receptacle connector band 200', a variety of alignment features may be utilized to ensure uninsulated sections 208 and 308 are aligned with one another in order to transmit power/data through the EHDT. One alignment feature is described in U.S. Pat. No.

7,252,437, entitled "FIBER OPTIC WET CONNETOR ACCELERATION PROTECTION AND TOLERANCE COMPLIANCE," naming Ringgenberg as inventor, co-owned by Halliburton Energy Services Inc., which is incorporated by reference in its entirety. In yet other alternative embodiments, the uncoated sections of the connector bands may be replaced with one or more conductors extending radially from the bands to transmits electrical/data signals therebetween.

Figure 4A:
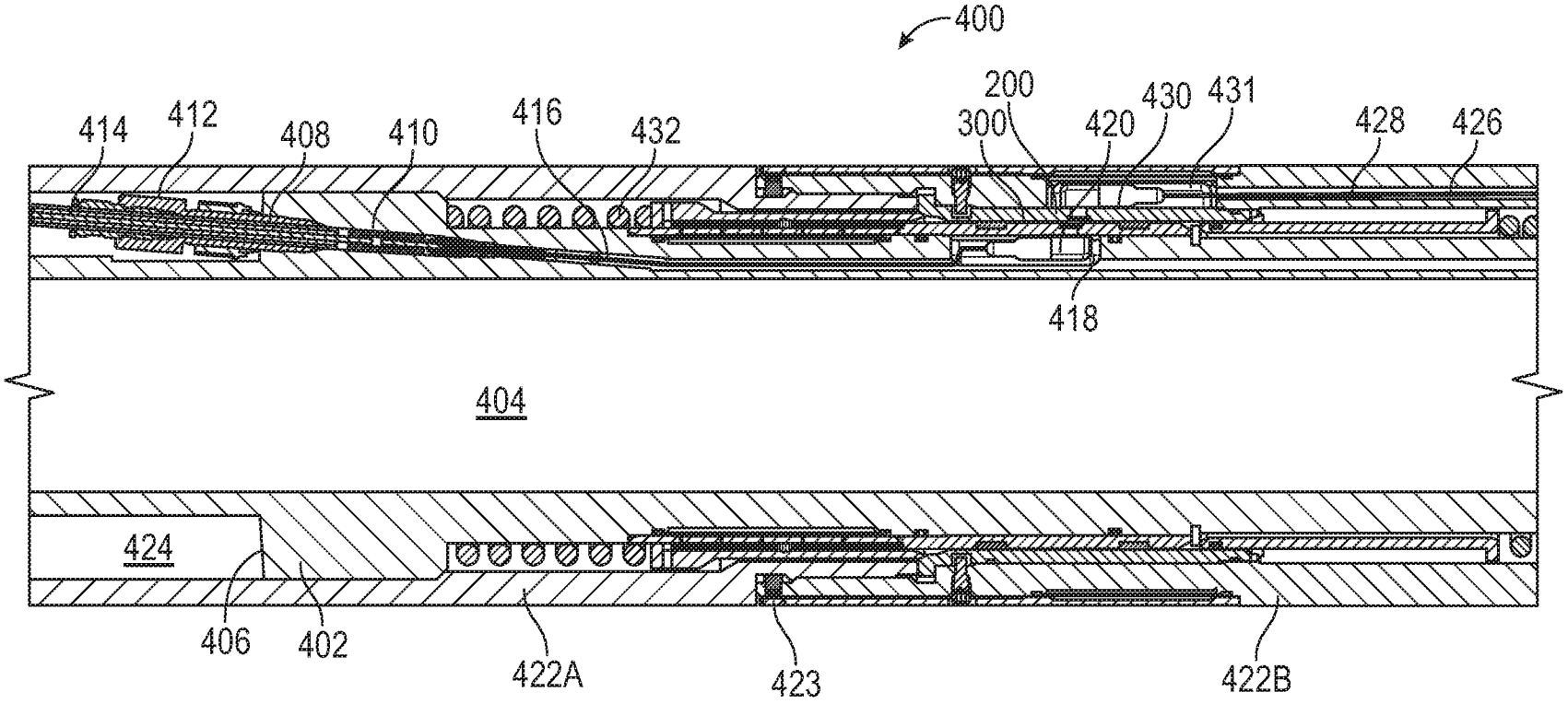
FIG. 4A is a sectional view of an assembled EHDT, according to certain illustrative embodiments of the present disclosure.

FIG. 4A is a sectional view of an assembled EHDT, according to certain illustrative embodiments of the present disclosure. For discussion purposes, consider EHDT 400 as being positioned along completion assembly 100 (FIG. 1) in place of EHDT 130. EHDT 400 includes male sub housing 402 having a bore 404 therethrough which, in this example, is used to produce downhole fluids. At the uphole end of male sub housing 402 is an external shoulder 406 having a port 408 connected to a channel 410 extending longitudinally along the axis of male sub housing 402. An electrical terminal fitting 412 is positioned inside port 408, which is electrically coupled to surface conductor 414 and internal conductor (e.g., wire) 416 that runs along channel 410.

A chamber 418 is positioned within male housing 402 and in fluid communication with channel 410. Male electrical connector 420 is positioned inside chamber 418 and is coupled to conductor 416 to provide power and/or data communication downhole. Male connector band 300 is positioned on housing 402 and in electrical contact with male electrical connector 420. In this embodiment, channel 410 and chamber 418 are filled with dielectric pressure compensation fluid (i.e., non-conductive fluid) in order to equalize pressure inside EHDT 400 during deployment and operation, as will be discussed in more detail below. Channel 410 is sealed by electrical termination fitting 412 at the uphole end of male housing 402. Although not shown, in this embodiment, the downhole end of channel 410 terminates inside housing 402 or is otherwise sealed/capped in order to keep the pressure compensation fluid within chamber 418 and channel 410.

As can be seen in FIG. 4A, the male sub housing 402 has been inserted into bore 424 of female receptacle sub housing 422A,B. Housing 422 is comprised of housing 422A and 422B, connected to one another via a fastener 423. Housing 422 also includes a channel 426 running along its axis to house a conductor/wire 428 coupled to female electrical connector 430. Female electrical connector 430 is positioned inside chamber 431. Although not shown, channel 426 runs to an exterior port (and electrical termination fitting) that allows conductor 428 to electrically couple to other devices further downhole. Female receptacle connector band 200 is in electrical contact with female electrical connector 430, thereby completing the electrical path between bands 300 and 200. Chamber 431 and channel 428 is also filled with pressure compensation fluid in order to equalize pressure inside EHDT 400 during deployment and operation. Channel 428 is also sealed by an electrical termination fitting (not shown) at the downhole end of receptacle housing 422 in order to maintain the pressure compensation fluid inside channel 428 and chamber 431.

Figure 4B:
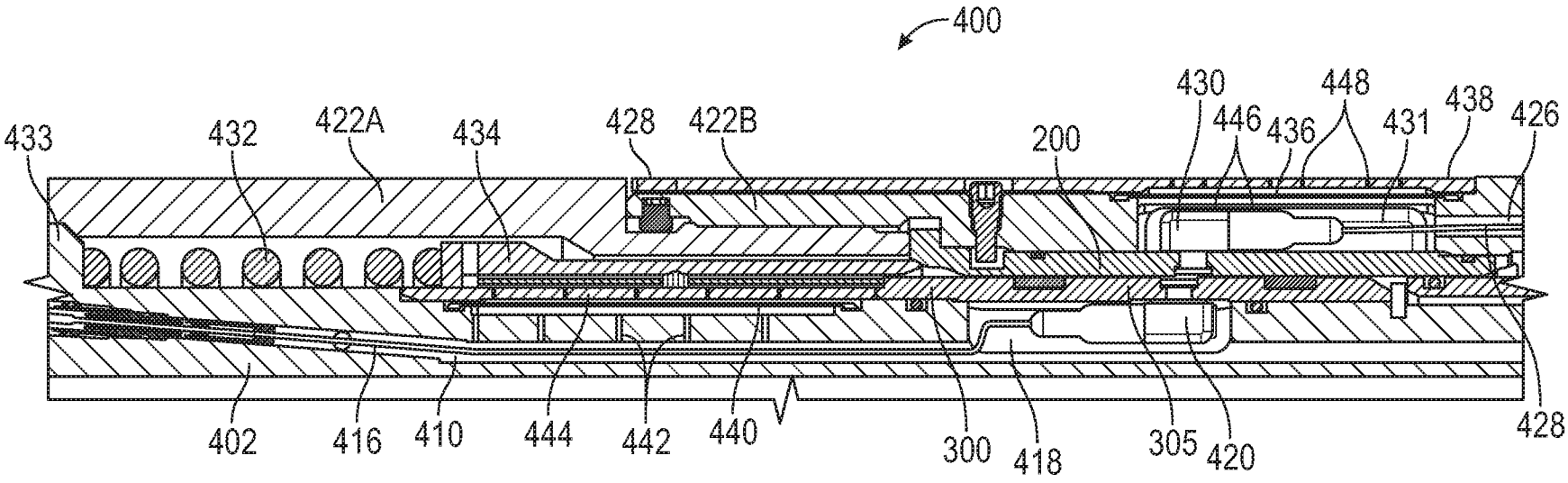
FIG. 4B is a detailed view of FIG. 4A and intended to show further details of this illustrative embodiment.

FIG. 4B is a detailed view of FIG. 4A and intended to show further details of this illustrative embodiment. A protection sleeve spring 432 is positioned around the exterior of male housing 402 in contact with external shoulder 433 to bias a protection sleeve 434 to a positioned atop male connector band 300, thereby protecting it during deployment downhole (FIG. 4B shows protection sleeve 434 in the open position. As male housing 402 is stabbed into bore 424 of female housing 422, protection sleeve 434 abuts the uphole end of female connector band 200, thus overcoming the bias strength of protection sleeve spring 432 and thus moving protection sleeve 434 into the open position to expose male connector band 300.

Still referencing FIG. 4B, a pressure compensation diaphragm 436 is positioned atop chamber 431. Pressure compensation diaphragm 436 is in fluid communication with chamber 431 and channel 426 via a plurality of channels 446 in the wall of chamber 431. Diaphragm 436, chamber 431 and channel 426 are filled with dielectric pressure compensation fluid. Diaphragm cover 438 is positioned along female housing 422B above pressure compensation diaphragm 436 for protection. Diaphragm cover 438 also includes a plurality of channels 448 that allow fluid communication between the annulus external to the EHDT and outside of diaphragm 436. During operation, the dielectric pressure compensation fluid inside chamber 431 and channel 426 is allowed to equalize with annulus pressure using diaphragm 436 via channels 446 and 448.

Another pressure compensation diaphragm 440 is positioned on the exterior of male housing 402. Channel 410 is in fluid communication with pressure compensation diaphragm 440 via channels 442. Another diaphragm protection cover 444 is positioned atop pressure compensation diaphragm 440 for protection. During deployment and operation, the dielectric pressure compensation fluid inside diaphragm 440, channel 410 and chamber 418 is allowed to communicate via channels 442 in order to equalize pressure as necessary.

Figure 4C:
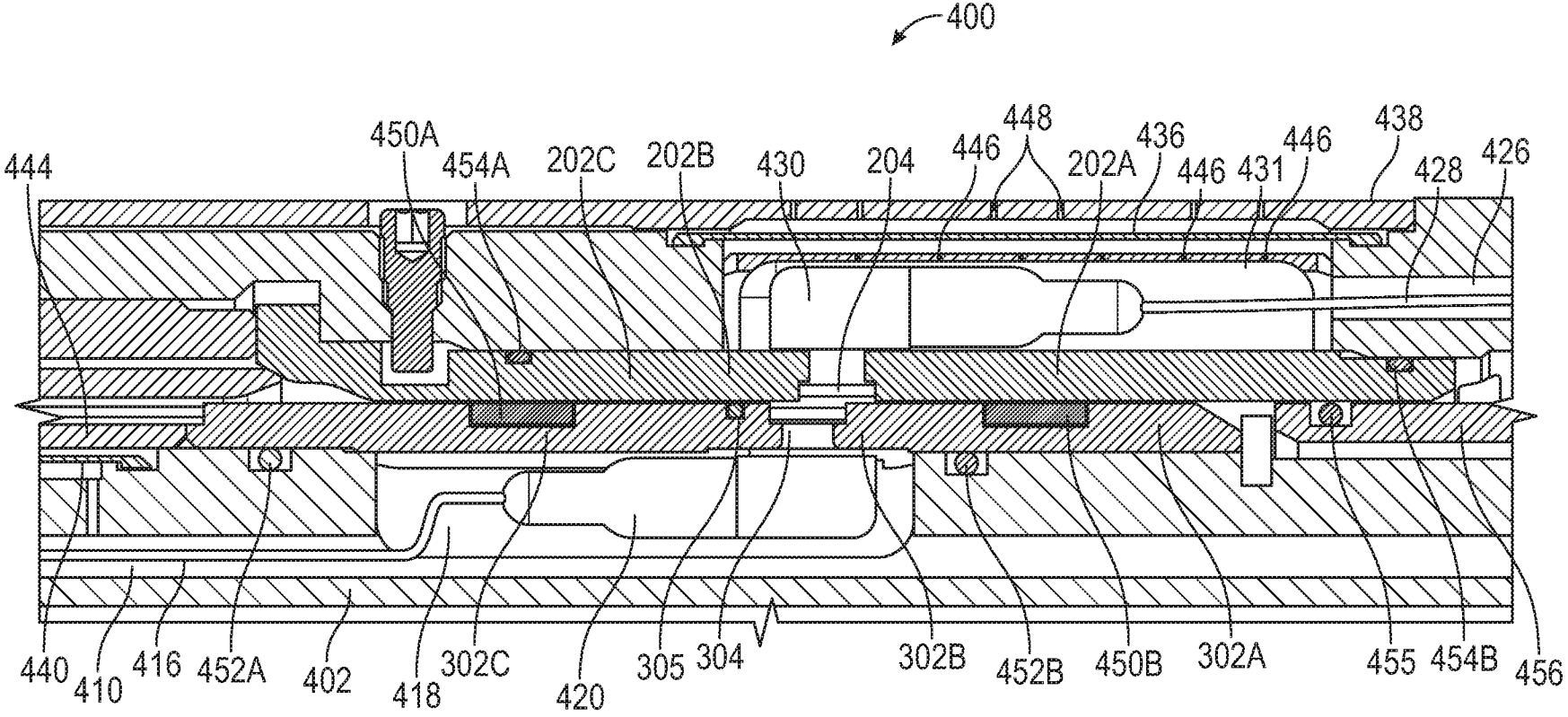
FIG. 4C is a detailed view of FIG. 4B necessary to show further details of the illustrative embodiment.

FIG. 4C is a detailed view of FIG. 4B necessary to show further details of the illustrative embodiment. First section 302A, second section 302B and third section 302C of male connector band 300 is shown. Second section 202B of receptacle connector band 200 is shown aligned with second section 302B of male connector band 300 to establish the electrical path. First section 202A and third section 202C are also shown being aligned with the respective sections of receptacle connector band 200. Fluid isolation seals 450A and 450B are positioned within grooves around male connector band 300 in order to seal against receptacle connector band 200, thereby providing fluid isolation for the electrical path between female electrical connector 430 and male electrical connector 420. Female electrical connector 430 includes a seal cap within connector port 204 to seal chamber 431 (and to seal the pressure compensation fluid inside chamber 431) from pressure and to protect connector 430 from fluid intrusion. Male electrical connector 420 also includes a seal cap within its connector port 304 to seal the pressure compensation fluid inside chamber 418 and to protect connector 420 from fluid intrusion and damage from pressure.

Further, a spring style electrical connector 305 is positioned inside a groove on male connector band 300 adjacent connector port 304. Electrical connector 305 can be, for example, a spring loaded pin, garter spring, or other similar spring style connector. As the connector band 300 enters the receptacle connector band 200, spring style electrical connector 305 will first make contact with the electrically insulated portion of receptacle connector band 200. As connector bands 200,300 come together, spring style electrical connector 305 comes into contact with the uncoated portion of receptacle connector band 200 to complete the electrical connection.

Still referring to FIG. 4C, O-ring seals 452A and 452B are positioned in grooves along male housing 402 in order to provide a pressure seal between male housing 402 and male connector band 300. Further, O-ring seals 452A and 452B provide a pressure and fluid seal for chamber 418 and male electrical connector 420. Likewise, O-ring seals 454A and 454B are positioned in grooves along female receptacle connector band 200 to provide a pressure seal between receptacle housing 422B and female connector band 200. Further, O-ring seals 454A and 454B provide a pressure and fluid seal for chamber 431 and female electrical connector 430. The various seals and design of the connector bands provide sufficient downhole corrosion resistance and pressure integrity such that EHDT 400 does not need an additional pressure compensation assembly.

Figure 4D:
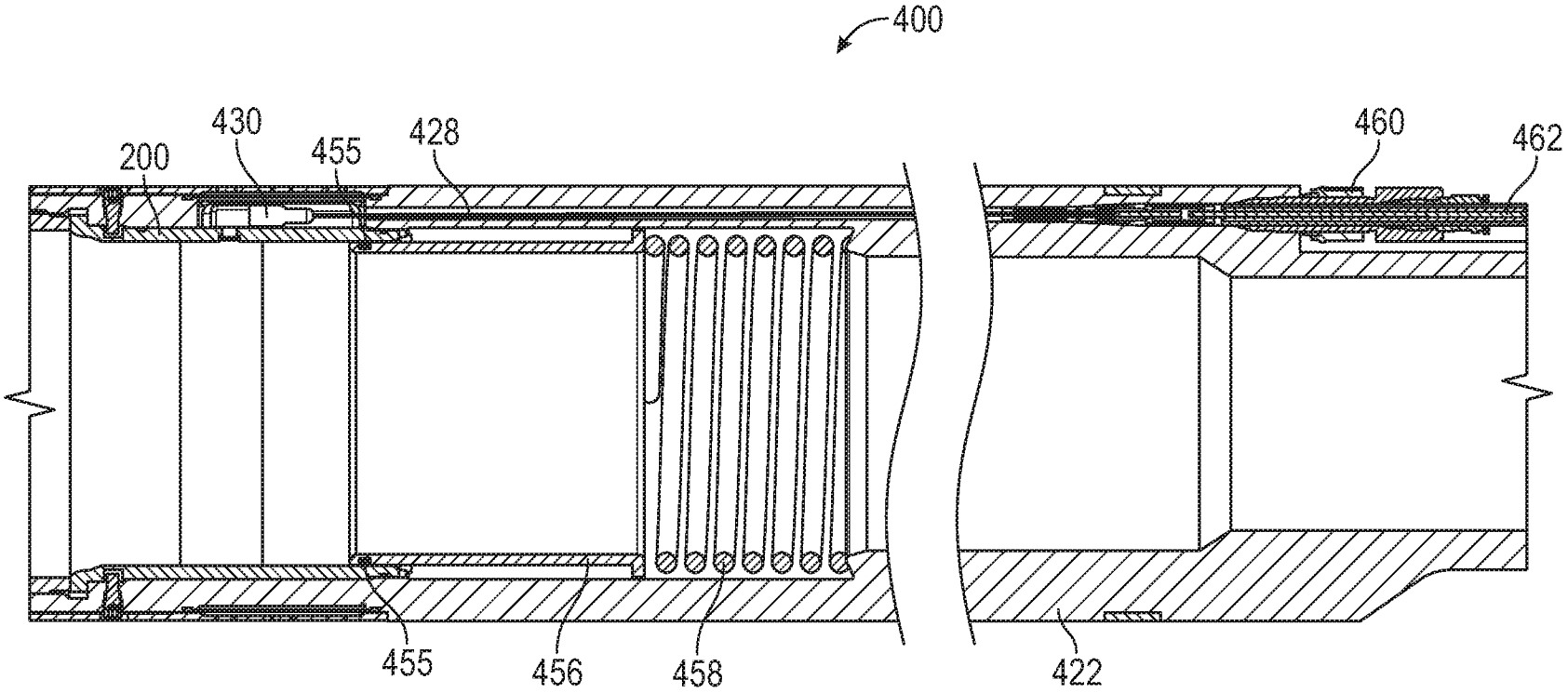
FIG. 4D is another sectional view of the downhole end of a female receptacle sub housing.

FIG. 4D is another sectional view of female sub housing 422 intended to show the downhole end of female sub housing 422. A protection sleeve 456 is positioned to protect female connector band 200 during deployment. In this figure, protection sleeve 456 is shown in its installed (open) configuration. In its uninstalled configuration, a spring 458 provides biasing force to push protection sleeve 456 atop connector band 200 to provide protection. However, in its installed configuration, male connector band 300 abuts protection sleeve 456 (as shown in FIG. 4C) and forces spring 458 to compress as shown in FIG. 4D. Another O-ring seal 455 is provided around protection sleeve 456 and provides a debris cleaning for female connector band 200 as the protection sleeve 456 slides along band 200 when male housing 402 (not shown) is stabbed into female housing 422 during installation.

FIG. 4D also illustrates how conductor 428 provides electrical coupling between female electrical connector 430 and electrical termination fitting 460. In addition, electrical termination fitting 460 provides a seal inside the external port of female receptacle housing 422. Another electrical conductor 462 is coupled to termination fitting 460 in order to provide electrical connectivity to tools further downhole.

Figure 5A:
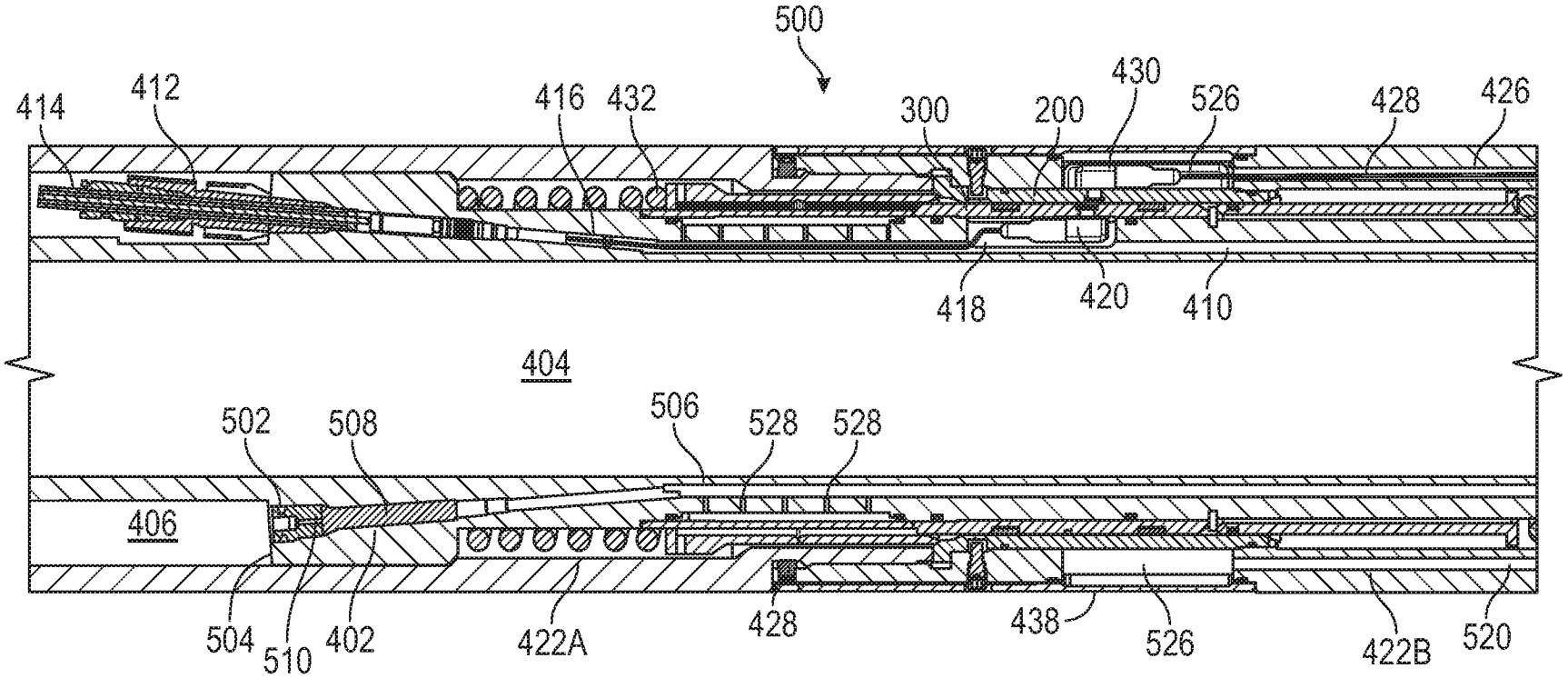
FIG. 5A is a sectional view of an EHDT having a pressure compensation assembly, according to certain illustrative embodiments of the present disclosure.

FIG. 5A is a sectional view of an EHDT 500 having a pressure compensation assembly, according to certain illustrative embodiments of the present disclosure. Various elements shown in FIG. 5A have already been described and are numbered accordingly. For simplicity, only the elements of the pressure compensation assembly will be described. The pressure compensation assembly of EHDT 500 includes port 502 located on an exterior shoulder 504 of male sub housing 402. Port 502 is in fluid communication with another channel 506 positioned axially long male sub housing 402. A dissolvable plug 508 is positioned along channel 506 near port 502. Dissolvable plug 508 is made of a material that dissolves when it comes into contact with downhole fluids. Illustrative dissolvable materials may include, for example, polyglycolid acid ("PGA") degradable plastics or magnesium alloys. Port 502 is capped off with a port plug 510 having a restricted inner diameter which governs the amount of downhole fluids allowed to enter channel 506. Note channel 410 is separate from channel 506; however, the two channels are in fluid communication with one another, as will be described in greater detail below.

Figure 5B:
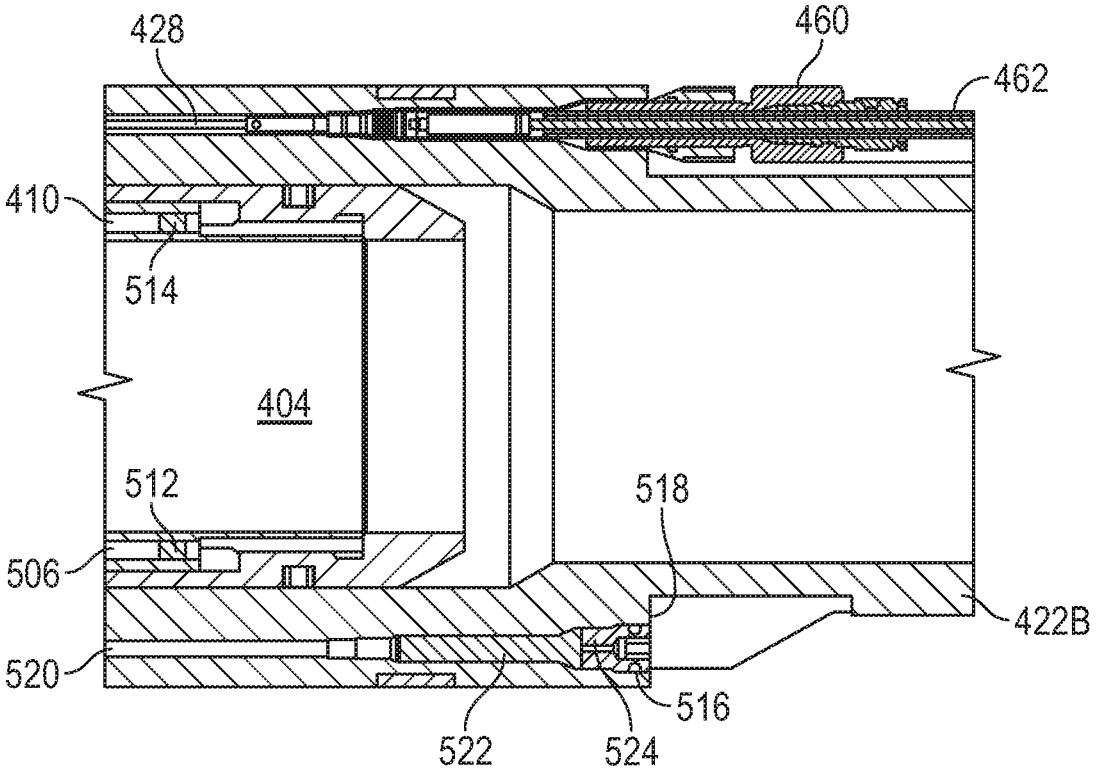
FIG. 5B is a sectional view of the downhole end of the EHDT of FIG. 5A.

FIG. 5B is a sectional view of the downhole end of EHDT 500. Again, like numerals refer to previously described elements. As can be seen, a pressure compensation chamber plug 512 is positioned along channel 506 in order to seal pressure compensation fluid inside channel 506. A second pressure compensation chamber pug 514 is positioned along channel 410 to keep pressure compensation fluid inside channel 410. EHDT 500 also includes a second port 516 located on an external shoulder 518 of female receptacle housing 422B. Port 516 is in fluid communication with another channel 520 which runs axially along receptacle housing 422B. Another dissolvable plug 522 is positioned inside channel 520 adjacent a port plug 524 having a restricted inner diameter to govern speed of fluids allowed to pass through plug 524.

With reference to FIGS. 5A and 5B, channel 520 is in fluid communication with an annular chamber 526 which houses female electrical connector 430 and the dielectric pressure compensation fluid. In this illustrative embodiment, wellbore fluid is able to comingle with the dielectric pressure compensation fluid (e.g., silicone oil) during deployment and operation as the tool pressures fluctuate. Wellbore fluid and dielectric pressure compensation fluid is allowed to flow through plug port 524 to thereby balance the pressure within receptacle housing 422. When EHDT 500 is manufactured, the dielectric pressure compensation fluid is installed in channels 506, 410, 426 and 520, and chambers 418 and 526. Dissolvable plugs 508 and 522 are installed in EHDT 500 to contain the dielectric pressure compensation fluid until EHDT 500 is run in hole. Plug ports 510 and 524 are installed in part to hold dissolvable plugs 508,522 in place. As previously described, plug ports 510 and 524 have a smaller restricted diameter hole to allow wellbore fluid to contact dissolvable plugs 508,522, at which time plugs 508,522 begin to dissolve. As plug material dissolves, wellbore fluid is able to enter channels 506 and 520 to balance the pressure inside chambers 418, 526 and channels 410, 426 of EHDT 500.

Figure 5C:
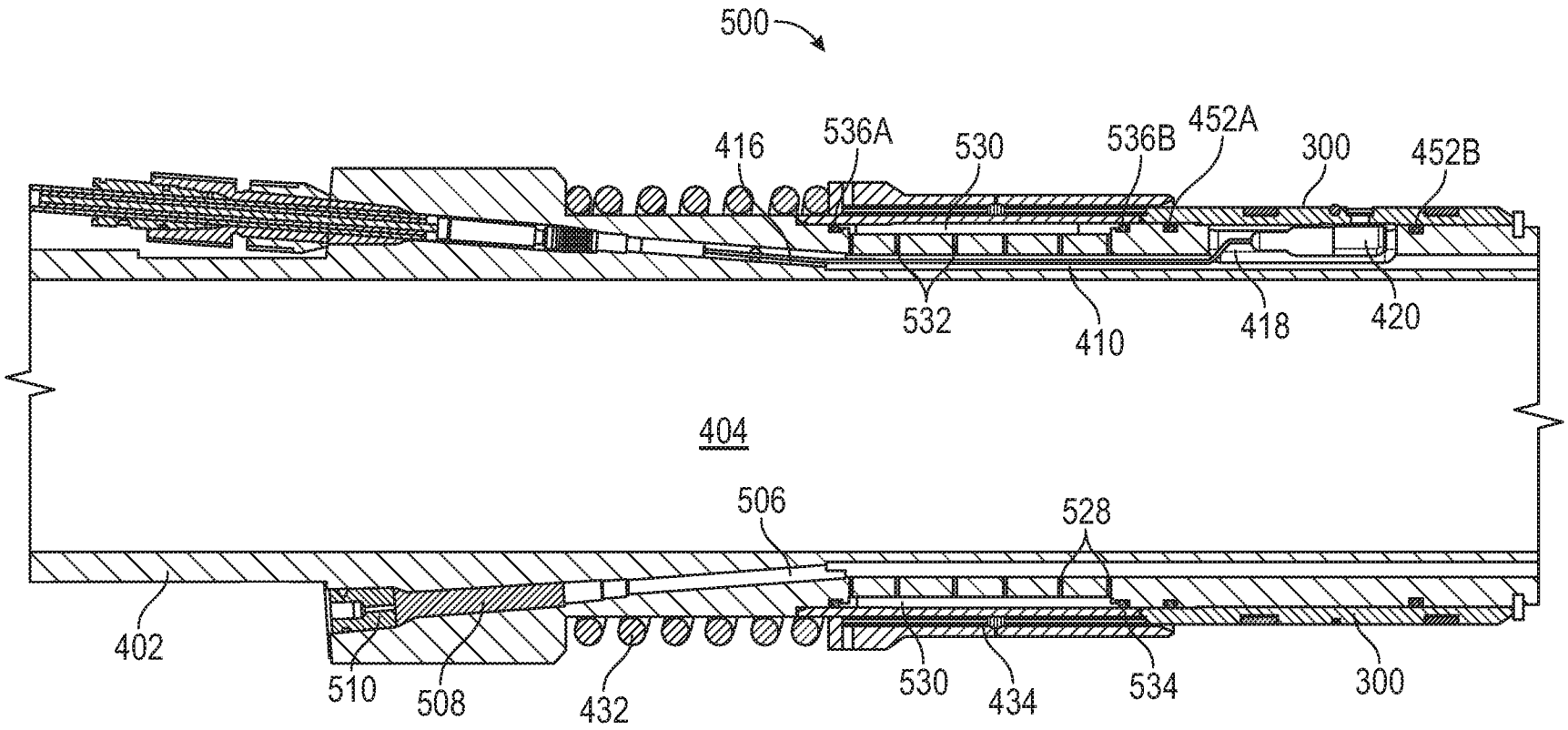
FIG. 5C is a detailed sectional view of the male sub housing in the installed configuration, in order to show further details of the pressure compensation assembly of FIG. 5A.

FIG. 5C is a detailed sectional view of male sub housing 402 in the installed configuration, in order to show further details of the pressure compensation assembly. Channel 506 is in fluid communication with one or more transverse channels 528 which are in fluid communication with annular pressure compensation fluid chamber 530. A chamber cover 534 covers annular pressure compensation fluid chamber 530, and two O-ring seals 536A,B seal cover 534 against housing 402. Dielectric pressure compensation fluid is held inside annular chamber 530 and, in turn, is also in fluid communication with a second set of transverse channels 532 that are in fluid communication with channel 410. As a result, the pressure inside chamber 418 housing male electrical connector 420 is compensated. In this illustrative embodiment, wellbore fluid is able to comingle with the dielectric pressure compensation fluid during deployment and operation as the tool pressure fluctuate. Wellbore fluid and dielectric pressure compensation fluid is allowed to flow through plug port 510 to thereby balance the pressure within male housing 402.

When EHDT 500 is manufactured, the dielectric pressure compensation fluid is installed in the tool, as previously described. Dissolvable plugs 508 and 522 are installed in EHDT 500 to contain the pressure compensation fluid until EHDT 500 is run in hole. Plug ports 510 and 524 are installed in part to hold dissolvable plugs 508,522 in place. As previously described, plug ports 510 and 524 have a smaller restricted inner diameter hole to allow wellbore fluid to contact dissolvable plugs 508,522, at which time plugs 508,522 begin to dissolve. As plug material dissolves, wellbore fluid is able to enter channels 506 and 520 to balance the pressure of EHDT 500. As fluid enters channel 506, it also enters transverse channel(s) 528, annular pressure compensation fluid chamber 530, and is communicated to channel 410 (and chamber 418) via transverse channels 532, thereby allowing for the pressure compensation. Among others, one of the benefits of the embodiment of FIGS. 5A-C is the elimination of the diaphragm or other similar pressure transmitting tool from the EHDT. Moreover, in an alternate embodiment, chamber cover 534 may be integrated with male connector band 300 to form a single part. In such alternate embodiments, one of the adjacent O-ring seals 536,452 may be removed.

Figure 6A:
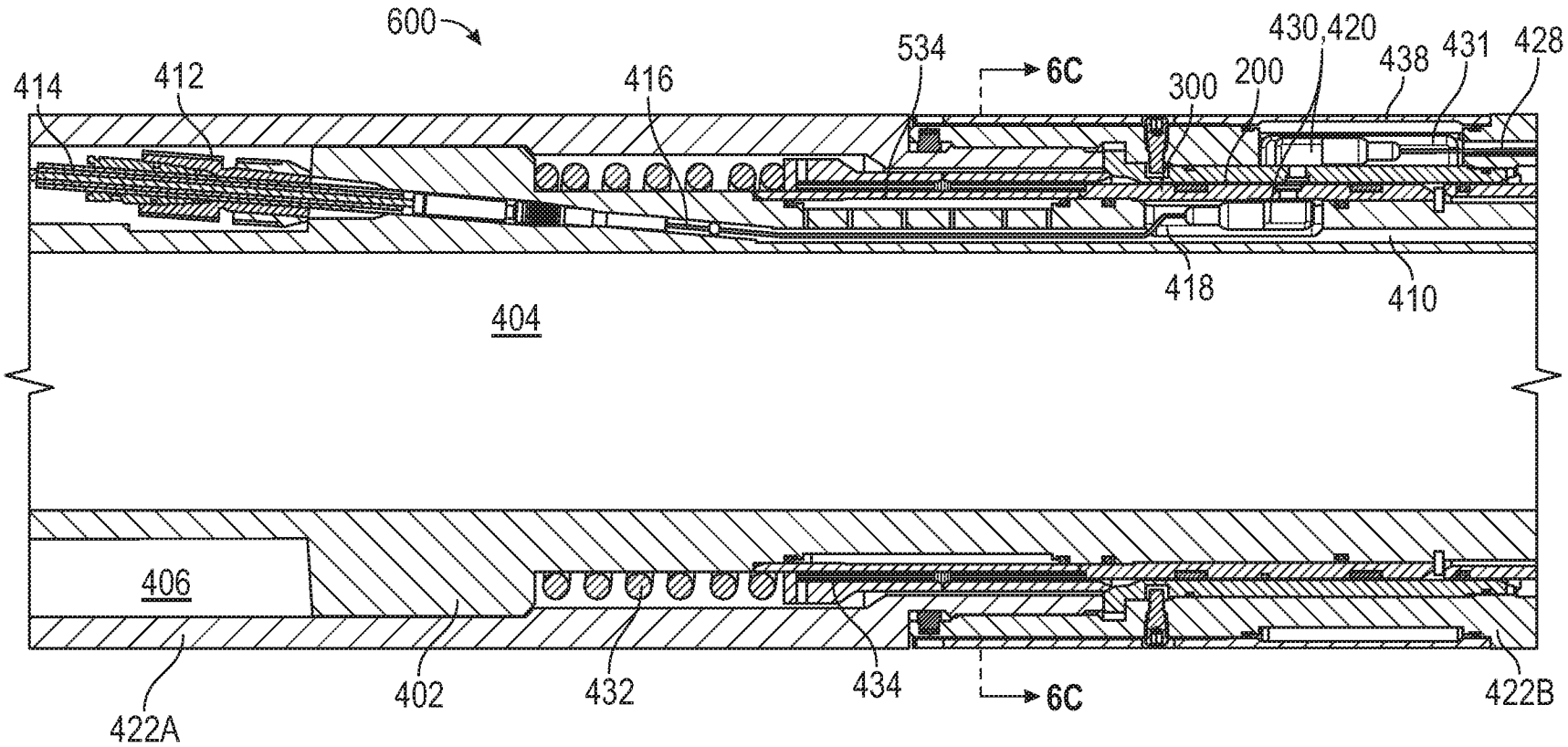
FIG. 6A is a sectional view of the uphole end of another EHDT according to another illustrative embodiment of the present disclosure.
Figure 6B:
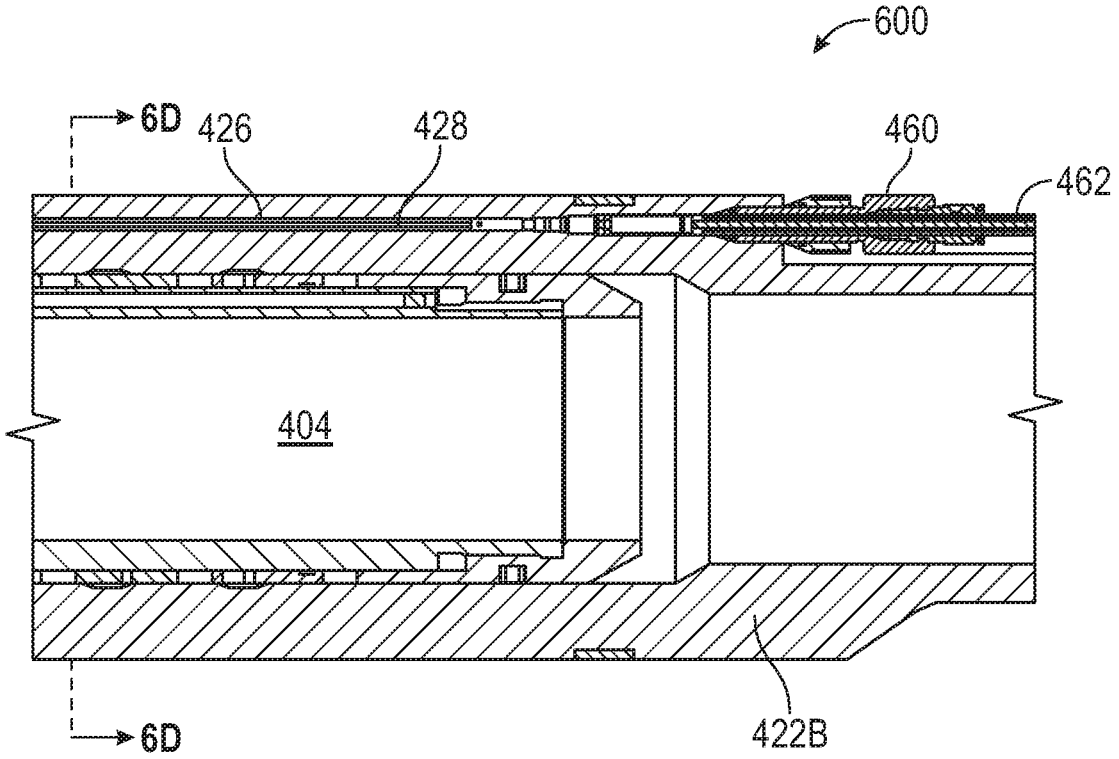
FIG. 6B is a sectional view of the downhole end of EHDT of FIG. 6A.

FIG. 6A is a sectional view of the uphole end of another illustrative embodiment of the present disclosure. FIG. 6B is a sectional view of the downhole end of this same EHDT embodiment. EHDT 600 uses two check valves with a predetermined opening pressure (e.g., 500 psi) to achieve pressure compensation and limit the comingling of wellbore and pressure compensation fluid. The benefit of this embodiment is the diaphragm or other pressure transmitting member is eliminated from the tool. EHDT 600 includes similar elements to those previously described, so like numerals refer to like elements.

Figure 6C:
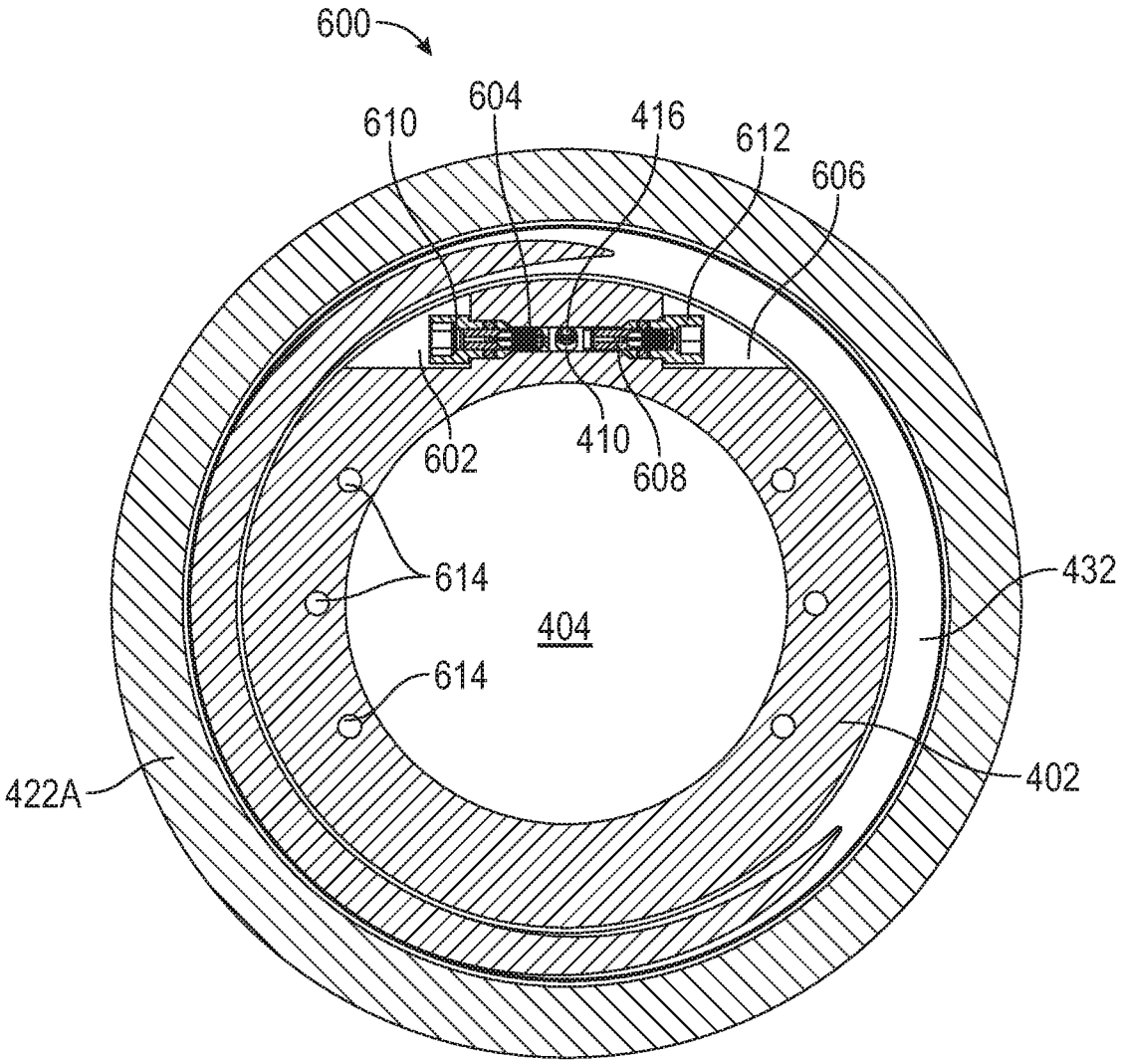
FIG. 6C is a sectional view of the EHDT taken along line C-C of FIG. 6A.

FIG. 6C is a sectional view of EHDT 600 taken along line C-C of FIG. 6A. A port 602 is positioned along the exterior surface of male sub housing 402. A channel 604 extends from port 602 in a direction transverse to the axis of male sub housing 402. Channel 604 is in fluid communication with channel 410 (which houses conductor 416) and the annulus of male sub housing 402. Another port 606 is positioned along the external surface of male sub housing 402 opposite port 602. Another channel 608 extends from port 606 in a direction transverse to the axis of male sub housing 402. Channel 608 is also in fluid communication with channel 410 and the annulus of male sub housing 402 (via port 606). A one-way check valve 610 is positioned along channel 604 between port 602 and channel 410. Another one-way check valve 612 is positioned along channel 608 between port 606 and channel 410. In this illustrative embodiment, check valve 610 allows wellbore fluid into channel 410 and check valve 612 allows fluid to flow outside channel 410 and into the annulus. However, in alternative embodiments the functions of check valves 610,612 may be reversed. Male sub housing 402 also includes a series of hydraulic channels 614 spaced circumferentially thereabout, through which hydraulic lines are run for hydraulic tool operations further downhole, as would be understood by those ordinarily skilled in the art having the benefit of this disclosure.

Check valves 610,612 (and the other check valves described herein) have a predetermined cracking pressure. As the dielectric pressure compensation fluid expands and builds pressure, the resultant pressure overcomes the check valve cracking pressure and the wellbore pressure and allow excess pressure to escape into the well. Selecting a cracking pressure of 500 psi, for example, would maintain a maximum differential of 500 psi higher pressure in the chambers (holding electrical connectors 420,430) than the wellbore pressure. As the wellbore pressure declines, the pressure of the pressure compensation fluid will overcome the cracking pressure of the check valve and vent to the well, which will maintain the 500 psi differential pressure.

Figure 6D:
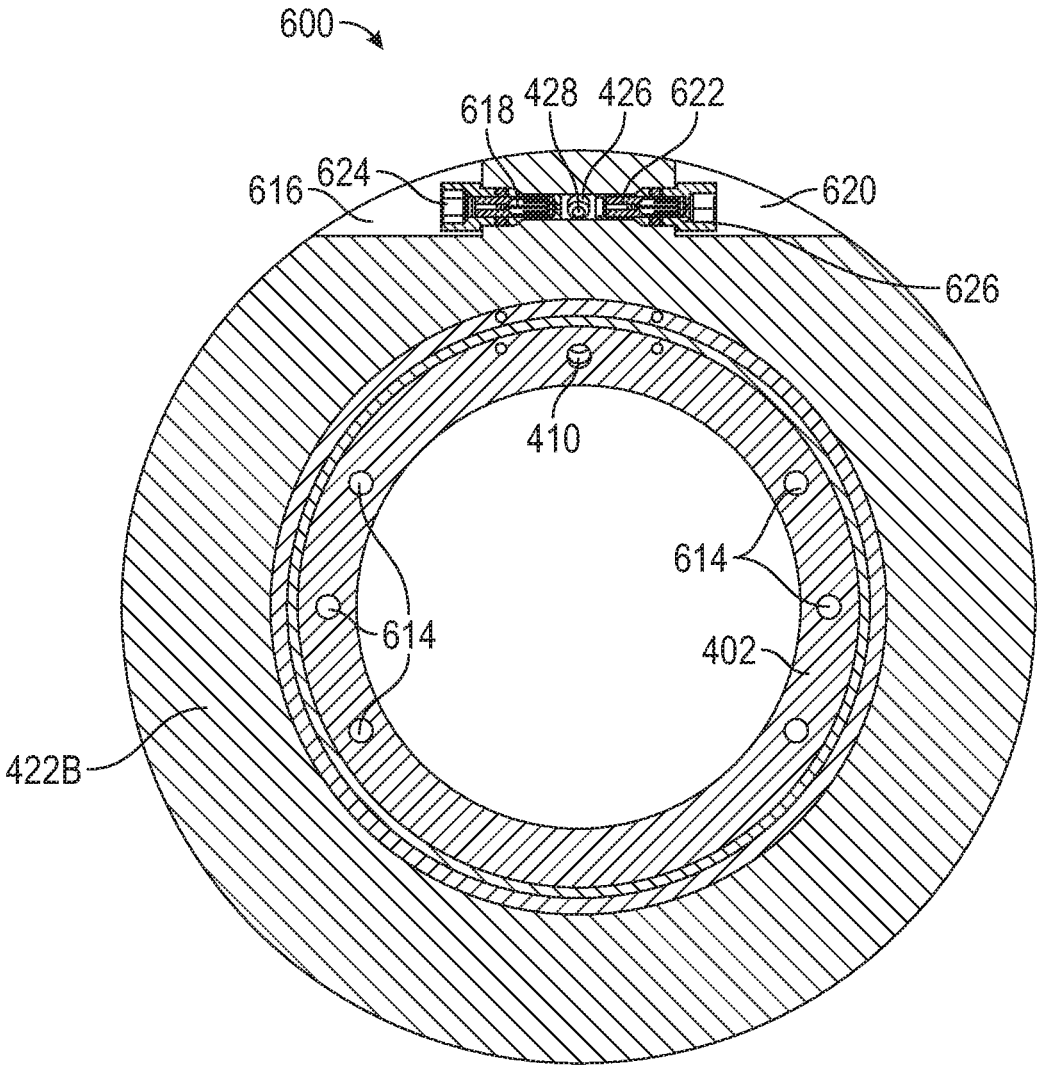
FIG. 6D is a sectional view of the EHDT taken along line D-D of FIG. 6B.

FIG. 6D is a sectional view of EHDT 600 taken along line D-D of FIG. 6B. A port 616 is positioned along the exterior surface of receptacle sub housing 422B. A channel 618 extends from port 616 in a direction transverse to the axis of receptacle sub housing 422B. Channel 618 is in fluid communication with channel 426 (which houses conductor 428) and the annulus of female receptacle sub housing 422B. Another port 620 is positioned along the external surface of receptacle sub housing 422B opposite port 616. Another channel 622 extends from port 620 in a direction transverse to the axis of receptacle sub housing 422B. Channel 622 is also in fluid communication with channel 426 and the annulus of receptacle sub housing 422B (via port 620). A check valve 624 is positioned along channel 618 between port 616 and channel 426. Another check valve 626 is positioned along channel 622 between port 620 and channel 426. In this illustrative embodiment, check valve 624 allows wellbore fluid into channel 426 and check valve 626 allows fluid to flow outside channel 426 and into the annulus. However, in alternative embodiments the functions of check valves 624,626 may be reversed.

As EHDT 600 is run in hole, the increased temperature of the wellbore will induce thermal expansion of the pressure compensation fluid inside channels 410 and 426 and chambers 431, 418, and 526 (which house electrical connectors 420,430 in various illustrative embodiments). In this embodiment, check valves 612,626 will open once the predetermined opening pressure is reached to allow some of the pressure compensation fluid inside channels 410,426 to escape into the wellbore annulus. This reduces the pressure of the compensation fluid. As EHDT 600 continues to run in hole, it is expected the downhole pressure will increase. Once the differential pressure of the wellbore exceeds the predetermined opening pressure of the check valves 610, 624, wellbore fluid will flow through valves 610,624 to enter channels 410,426 to maintain the predetermined pressure differential. As wellbore operations change, this process may repeat (e.g., water injection may cool EHDT 600 resulting in a decrease of compensation fluid pressure) and depletion of the well may decrease the downhole pressure (e.g., EHDT 600 internal pressure may exceed the predetermined opening pressure and vent to the wellbore).

Figure 7A:
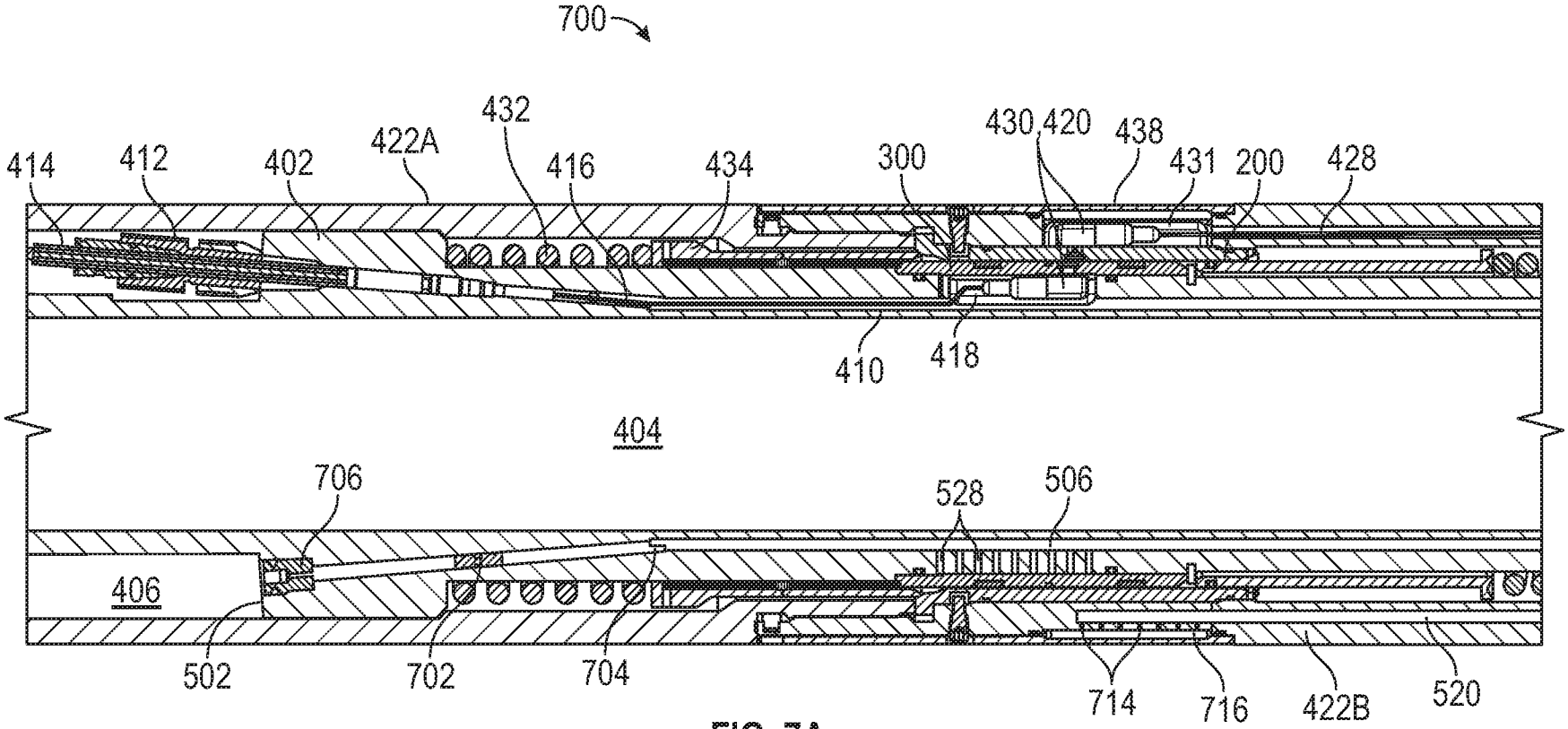
FIG. 7A is a sectional view of an uphole end of another EHDT using floating pistons, according to an alternate embodiment of the present disclosure.

FIG. 7A is a sectional view of an uphole end of another EHDT using floating pistons, according to an alternate embodiment of the present disclosure. EHDT 700 is similar to other EHDTs described herein, thus like numerals refer to like elements. EHDT 700 includes a floating piston 702 positioned along channel 506. In response to pressure differentials across channel 506, floating piston 702 is allowed to float between port 502 and a reduced diameter section 704 of channel 506. A plug port 706 having a reduced inner diameter allowing hydraulic communication with the wellbore is positioned at port 502. Plug port 706 and reduced diameter section 704 limit the travel of floating piston 702 as pressure is compensated.

Figure 7B:
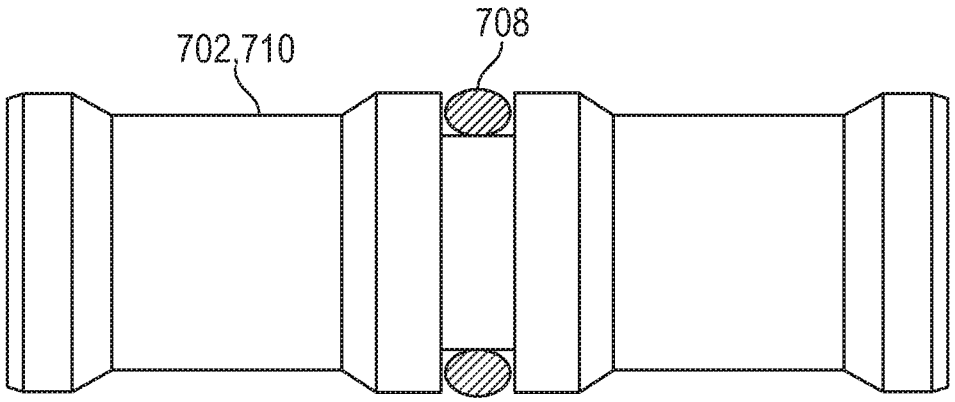
FIG. 7B is a three-dimensional view of the floating piston of FIG. 7A, according to certain illustrative embodiments of the present disclosure.

As in previous embodiments, channel 506 and chamber 418 are filled with dielectric pressure compensation fluid during assembly of EHDT 700. As pressure differentials across channel 506 occur during deployment and operation of EHDT 700, floating piston 702 floats between plug port 706 and reduced diameter section 704, thus allowing wellbore fluid to enter/leave plug port 706. As this occurs, the pressure equalizes across transverse channels 528, chamber 418 that houses electrical connector 430, and channel 410. FIG. 7B is a three-dimensional view of floating piston 702. O-ring seal 708 seals against the wall of channel 506 as floating piston moves along channel 506. As a result, floating piston 702 prevents the pressure compensation fluid inside channel 506 from leaking out into the wellbore annulus.

Figure 7C:
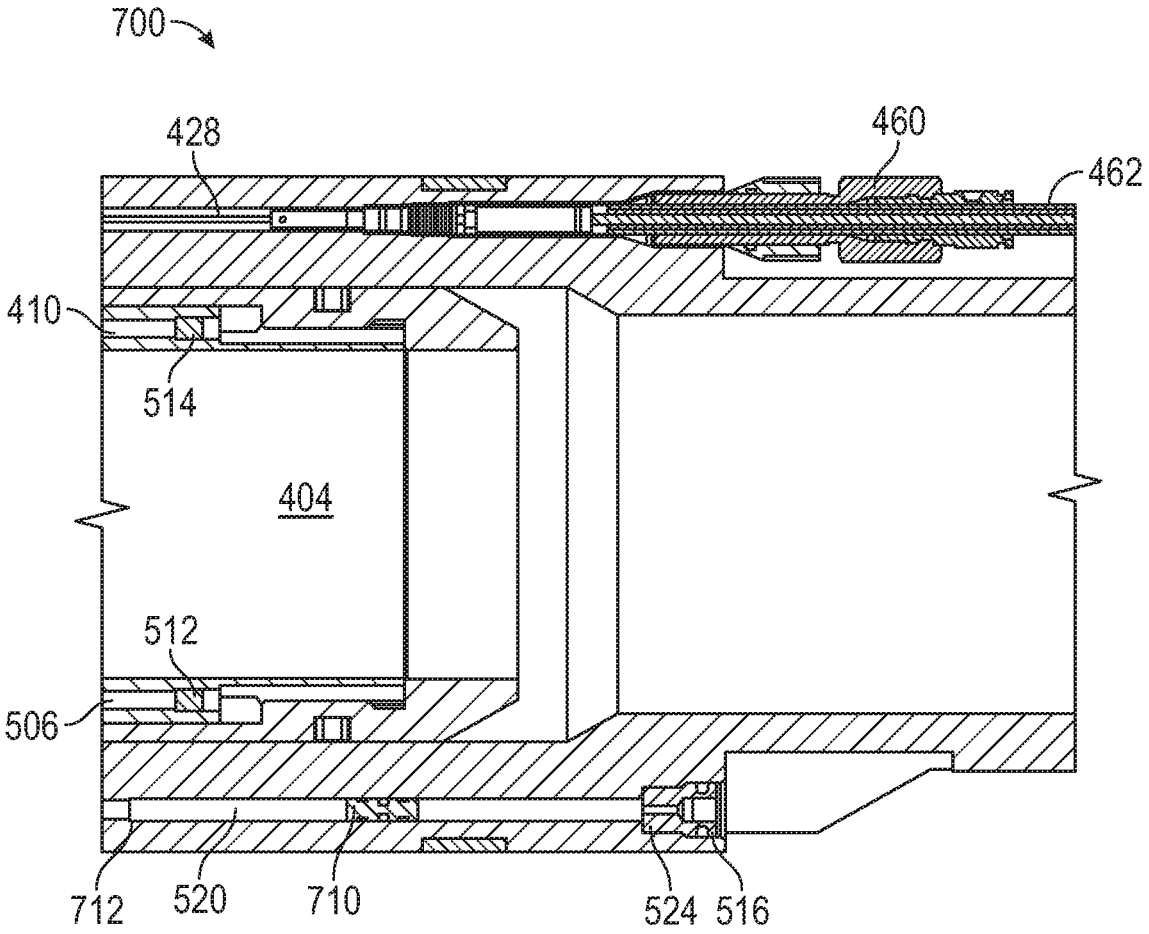
FIG. 7C is a sectional view of the downhole end of the EHDT of FIG. 7A.

FIG. 7C is a sectional view of the downhole end of EHDT 700. Again, like numerals refer to like elements previously described. However, in this illustrative embodiment, channel 520 also includes a floating piston 710 that floats between plug port 524 and a reduced diameter section 712 of channel 520. As previously described, floating piston 710 is thereby allowed to float between plug port 524 and reduced diameter section 712 during pressure compensation. Channel 520 is also filled with pressure compensation fluid. Further, in this embodiment, channel 520 is in fluid communication with chamber 431 (housing female electrical connector 420) via transverse channels 714. Channels 714 communicate fluid from/to annular chamber 716, which communicates fluid to chamber 431 via channels (not shown) in the wall of chamber 431, thereby balancing the pressure. Furthermore, as with floating piston 702, floating piston 710 also maintains the pressure compensation fluid inside channel 520 and chamber 431. The pressure is compensated as wellbore fluid is allowed inside/outside port plug 524, while piston 702 floats, as previously described.

Figure 7D:
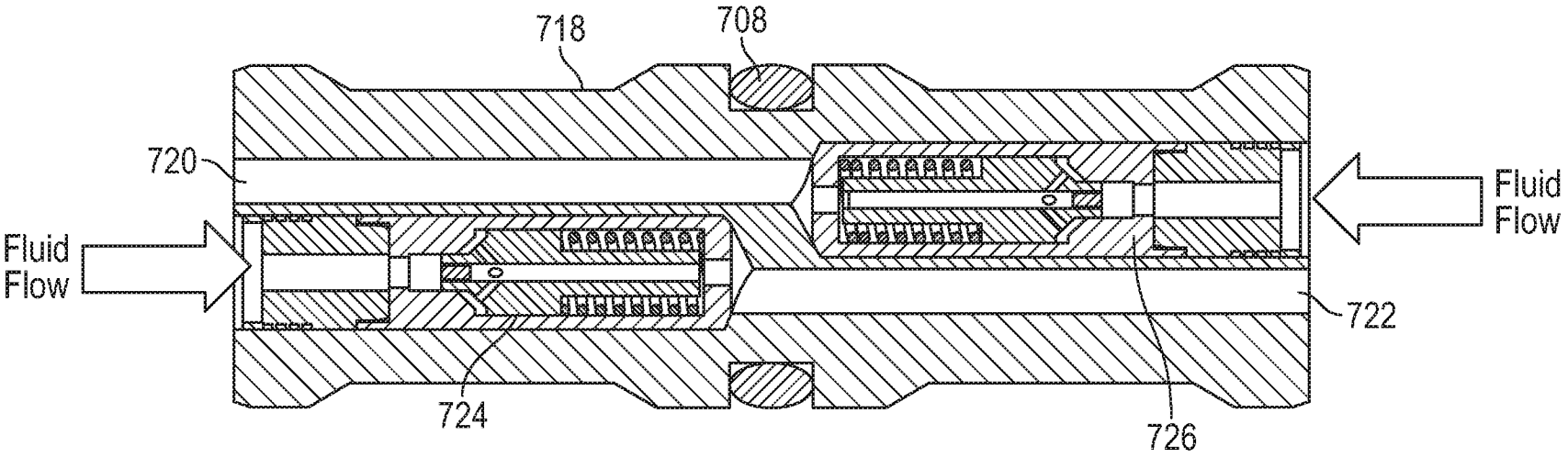
FIG. 7D is a sectional view of another floating piston, according to an alternative embodiment of the present disclosure.

FIG. 7D is a sectional view of another floating piston, according to an alternative embodiment of the present disclosure. Floating piston 718 includes a first bore 720 and a second bore 722 extending therethrough. A one-way check valve 724 is positioned along bore 720 and another one-way check valve 726 is positioned along bore 722. This alternate embodiment of floating piston 718 prevents excessive pressure buildup with EHDT 700 when the piston travel length (the length between plug ports 706/524 and reduced diameter sections 704,712) is so short the floating piston is unable to move sufficiently to balance the pressure.

In this illustrative embodiment, floating piston 718 would be positioned such that the maximum amount of dielectric pressure compensation fluid is used to fill the chambers 431,418. As the temperature increases, pressure in excess of the cracking pressure of check valves 724,726 and the well pressure will vent to the well through the one-way check valves 724,726. In the illustrated example, valves 724,726 are installed in such that one valve is to allow excess pressure to escape the tool and the opposing valve is to allow wellbore fluid to enter the tool to maintain the pressure balance should well conditions change. As the well pressure increases, it will apply pressure to chambers 418,431. As the wellbore pressure decreases, excess pressure in chambers 418,431 will vent to the well. The benefit to this design is that if the wellbore temperature decreases due to being shut in while the upper completion is pulled and replaced, floating piston 718 will maintain the pressure balance where wellbore fluid will begin to enter the EHDT and the pressure differential across the connector bands will increase (amount of increase should be tolerable). When production resumes and the temperature increases, the pressure compensation fluid can expand and push floating piston 718 to maintain the pressure balance.

Figure 8A:
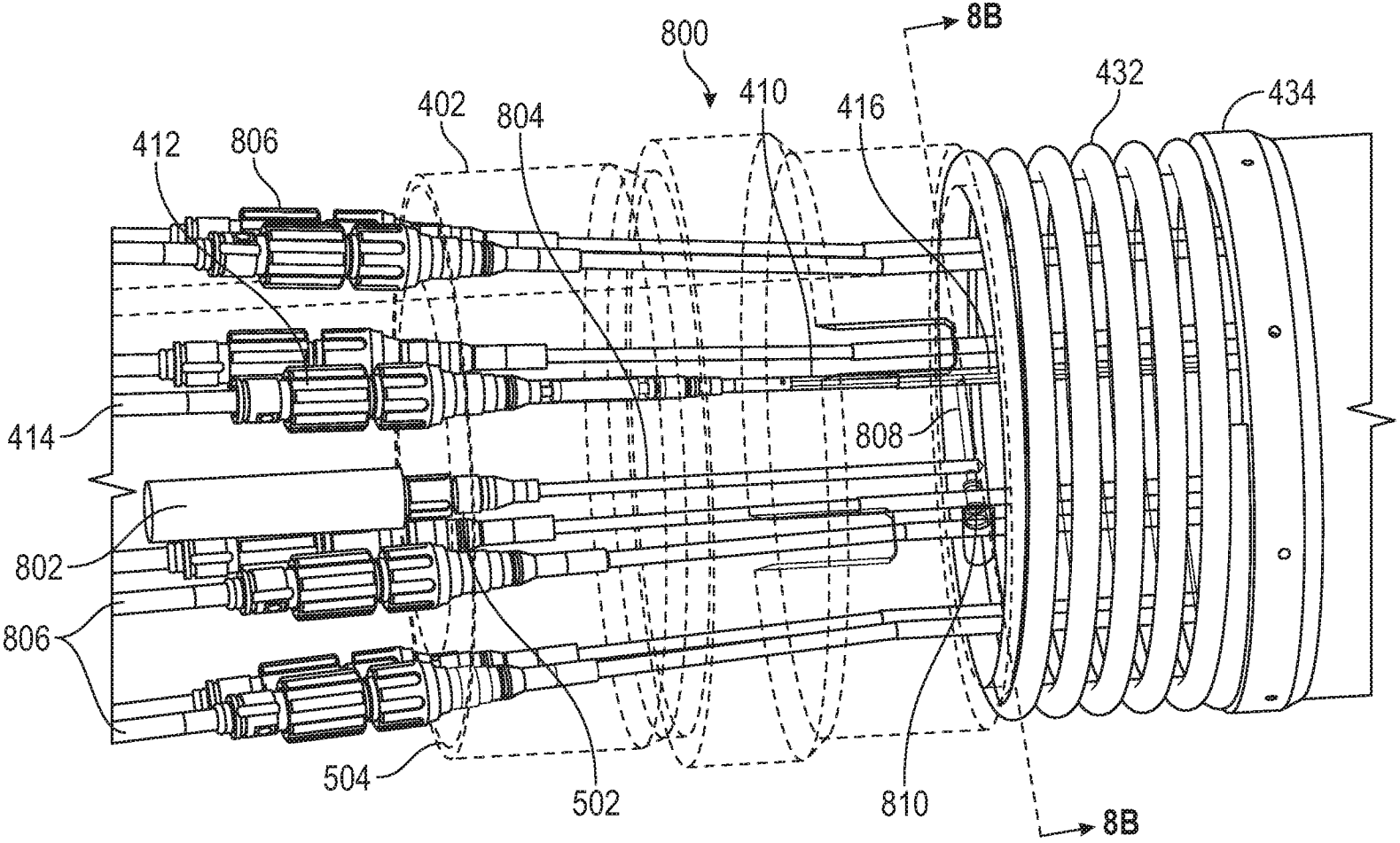
FIG. 8A is a three-dimensional view of the uphole end of a EHDT having a bellows assembly for pressure compensation, according to certain illustrative embodiments of the present disclosure.

FIG. 8A is a three-dimensional view of the uphole end of a EHDT having a bellows assembly for pressure compensation, according to certain illustrative embodiments of the present disclosure. EHDT 800 includes elements similar to previous embodiments, so like numerals refer to like elements. However, EHDT 800 includes a bellows assembly 802 inserted inside port 502 located within shoulder 504 of male sub housing 402. Bellows assembly 802 is shown having a protective housing that protects the bellow (inside the housing) from damage during assembly of EHDT 800 or during shipping or handling. As will be understood by those ordinarily skilled in the art having the benefit of this disclosure, a metal bellows is a precision-engineered, flexible metal component that acts as a leak tight seal—effectively separating two environments from one another. The versatile bellow parts can convert changes in pressure, temperature and position into linear motion.

During the assembly process, EHDT 800 is filled with dielectric fluid to provide internal pressure to counteract the external pressure of the wellbore. Bellows assembly 802 functions as a flexible pressure barrier, isolating the pressure compensation fluid in the tool from the wellbore fluid. As the wellbore pressure increases, it applies force to the outside of bellows assembly 802. The force applied to the outside of bellows assembly 802 compresses the bellows (not shown) inside. As the bellows are compressed, the internal pressure in EHDT 800 is increased as the volumetric area is decreased. As the wellbore pressure continues to increase, bellows inside bellows assembly 802 will be compressed further which reduces the volumetric area and increases pressure in EHDT 800. Similarly, if the wellbore pressure decreases, the internal tool pressure will exert a force on the inside of the bellows. This force expands the bellows which increases the volumetric area and reduces the internal tool pressure.

A channel 804 axially extends along male sub housing 402 and is in fluid communication with port 502. A number of hydraulic line fittings 806 are also positioned radially around sub housing 402 to provide hydraulic control for downhole tools, as will be understood by those ordinarily skilled in the art having benefit of this disclosure.

Figure 8B:
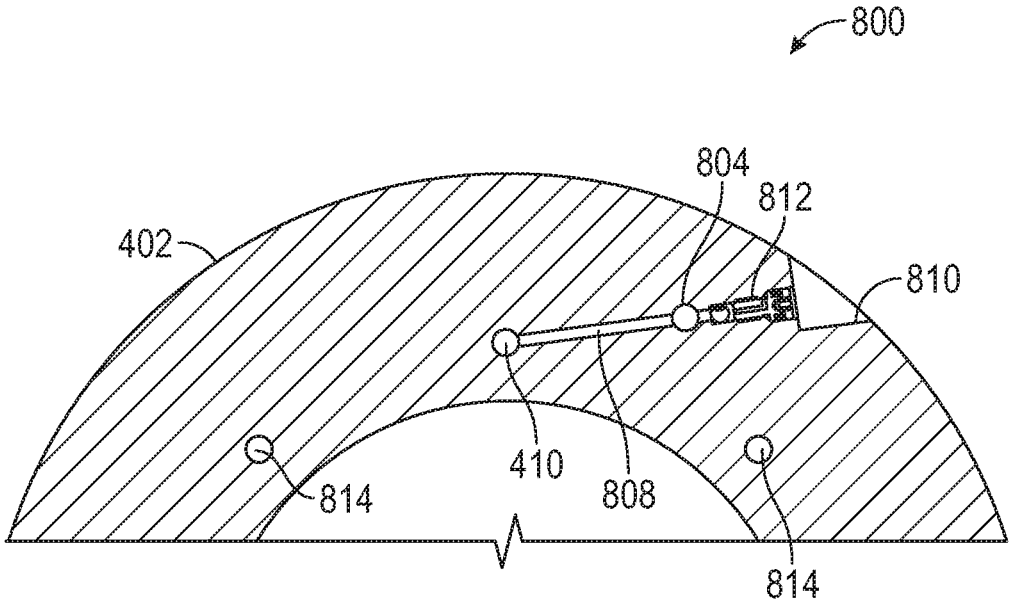
FIG. 8B is a sectional view taken along line B-B in FIG. 8A.

Still referring to FIG. 8A, a transverse channel 808 is in fluid communication with channel 804 and channel 410. During manufacture of EHDT 800, channels 804, 808 and 410 (and the chamber housing male electrical connector 420) are filled with pressure compensation fluid. A pressure compensation port 810 is located along male sub housing 402 and is in fluid communication channels 808 and 804. Pressure compensation port 810 is where the pressure compensation fluid is filled inside the tool. Once filled, port 810 is plugged. In this embodiment, bellows assembly 802 performs the pressure compensation (compressed by higher pressure and extended when well pressure is less than the compensation fluid pressure in the tool). FIG. 8B is a sectional view taken along line B-B in FIG. 8A. As can be seen, port 810 includes a plug 812 having an O-ring seal to seal in the pressure compensation fluid. Port 810 is only used to fill the tool with the pressure compensation fluid (thereafter it is sealed with plug 812). Channels 814 house the hydraulic lines (not shown) that axially extend along housing 402 and provides hydraulic control of downhole tools.

During operation, as EHDT 800 is run-in-hole, the bellows assembly will be subjected to an increase in wellbore pressure. This increase in pressure will compress the bellows assembly which applies pressure to the compensation fluid inside the tool. This process results in a balance of pressure between the well bore and the internal channels of the tool which ultimately balance the pressure between the ID and OD of the connector bands. Also, as EHDT 800 is run-in-hole, it will be in contact with higher temperature fluid. The increase in temperature will cause the pressure compensation fluid to expand which increases the pressure inside EHDT 800. Metal bellows assembly 802 will expand to balance the pressure inside the tool with the wellbore pressure.

Figure 8C:
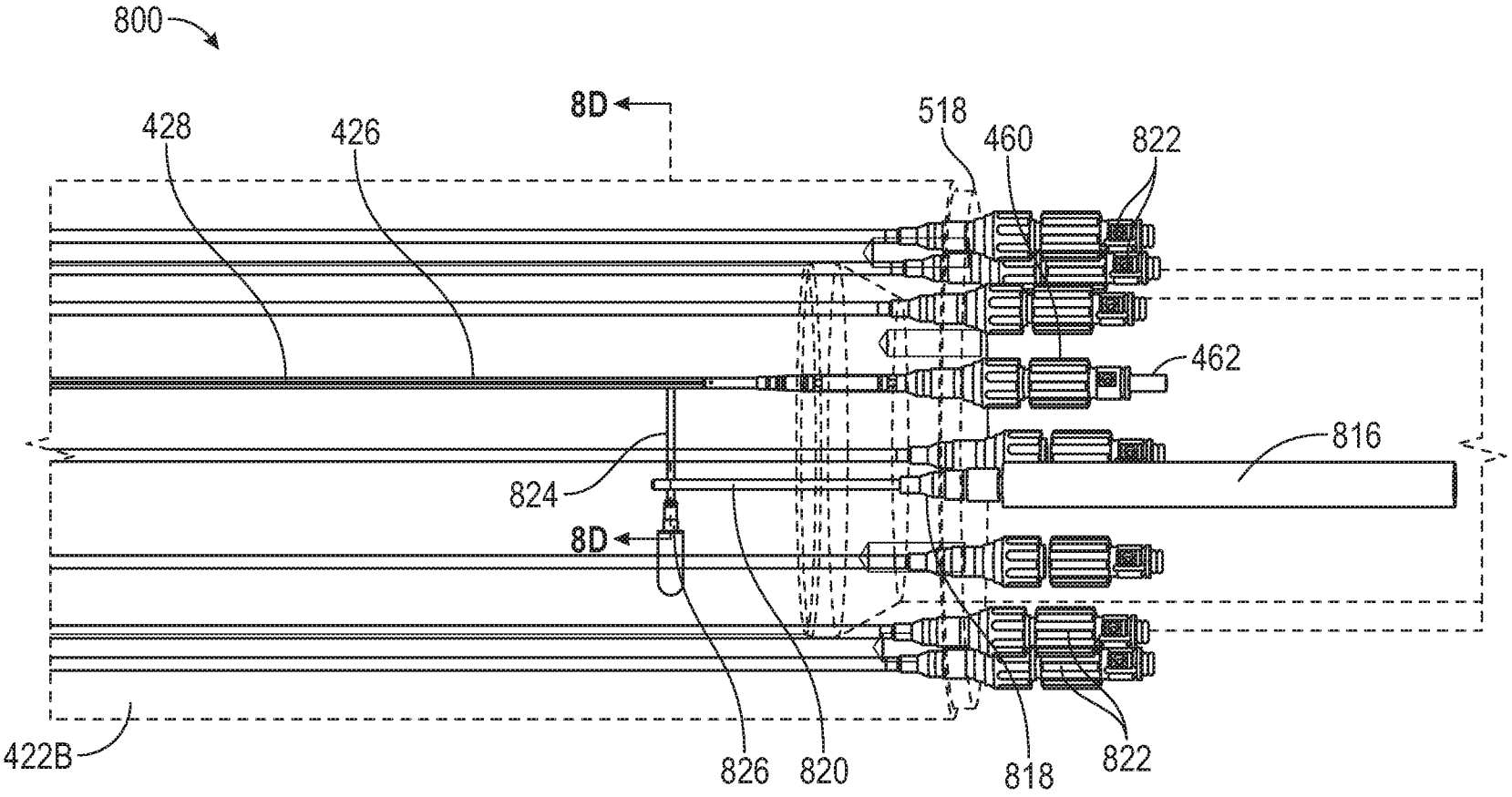
FIG. 8C is a three-dimensional view of the downhole end of the EHDT of FIG. 8A.

FIG. 8C is a three-dimensional view of the downhole end of the EHDT 800. EHDT 800 includes a bellows assembly 816 inserted inside port 818 located within shoulder 518 of female receptacle housing 422B. During operation, bellows assembly 816 expands and contracts in response to the pressure balance between the wellbore fluid and the pressure compensation fluid inside the tool, as previously described. Channel 820 axially extends along receptacle housing 422B and is in fluid communication with port 818. A number of hydraulic line fittings 822 are also positioned radially around receptacle housing 422B to provide hydraulic control for downhole tools, as will be understood by those ordinarily skilled in the art having benefit of this disclosure.

Figure 8D:
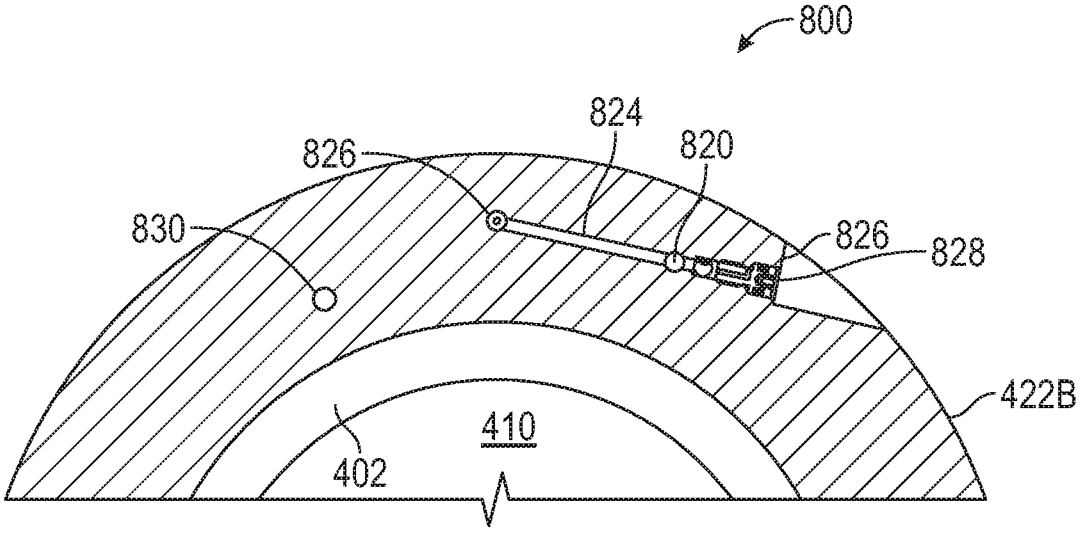
FIG. 8D is a sectional view taken along line D-D in FIG. 8C.

Still referring to FIG. 8C, a transverse channel 824 is in fluid communication with channel 820 and channel 426 housing conductor 428. During manufacture of EHDT 800, channels 820, 824 and 426 (and the chamber housing female electrical connector 430) are filled with dielectric pressure compensation fluid. A pressure compensation fill port 826 is located along female receptacle housing 422B and is in fluid communication channels 820 and 824. Port 826 is only used to fill the tool with pressure compensation fluid, then it is plugged. FIG. 8D is a sectional view taken along line D-D in FIG. 8C. As can be seen, port 826 includes a seal plug 828 to keep the pressure compensation fluid inside the tool. Note, in alternative embodiments, fill port 826 (or others described herein) may not be needed if, for example, the port used for the bellows assembly is used to fill the tool before the bellow assembly is attached. Channels 830 house the hydraulic lines (not shown) that axially extend along housing 422B and provides hydraulic control of downhole tools.

Figure 8E:
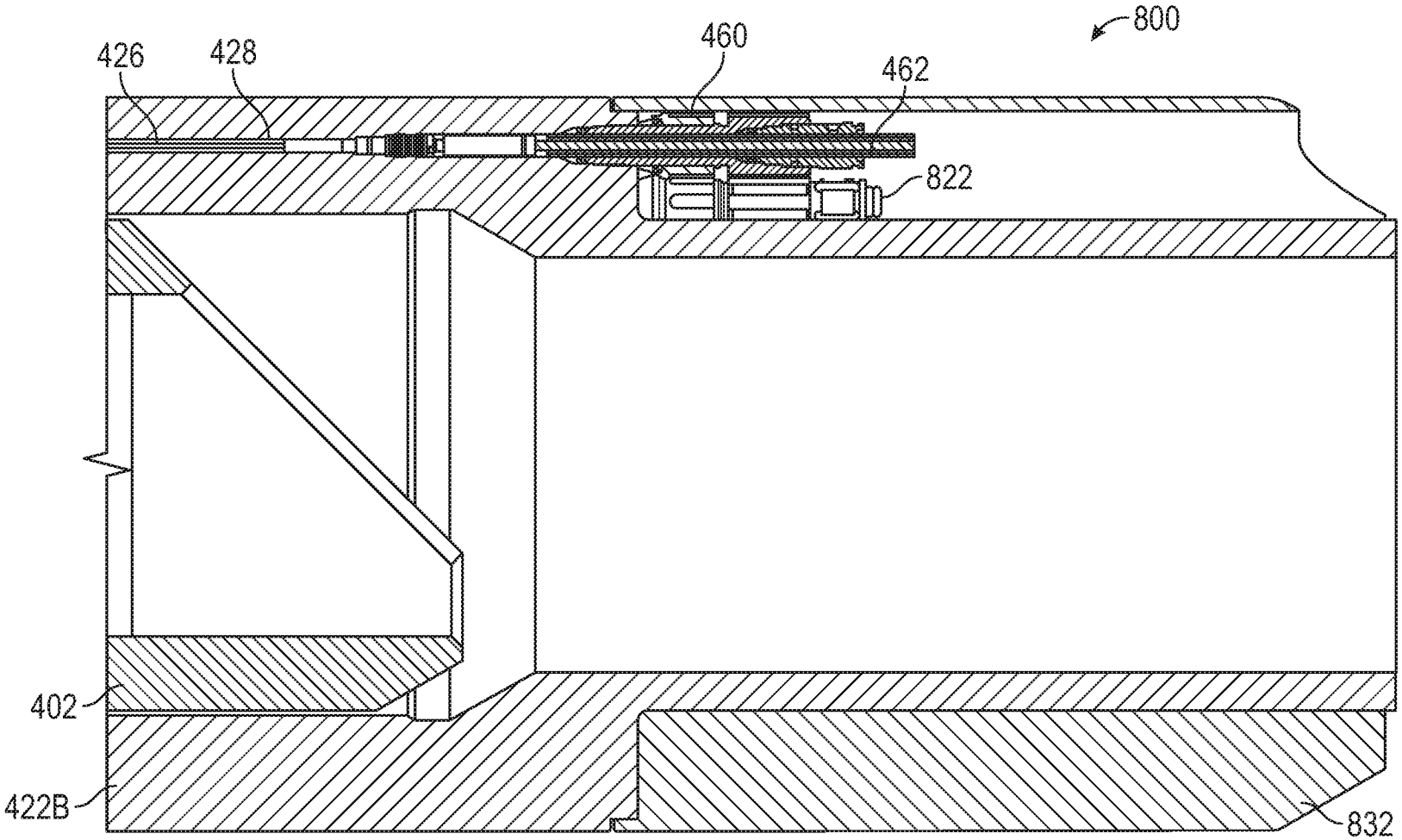
FIG. 8E is another sectional view of the downhole end of the EHDT of FIG. 8A, accordingly to another illustrative embodiment of the present disclosure.
Figure 8F:
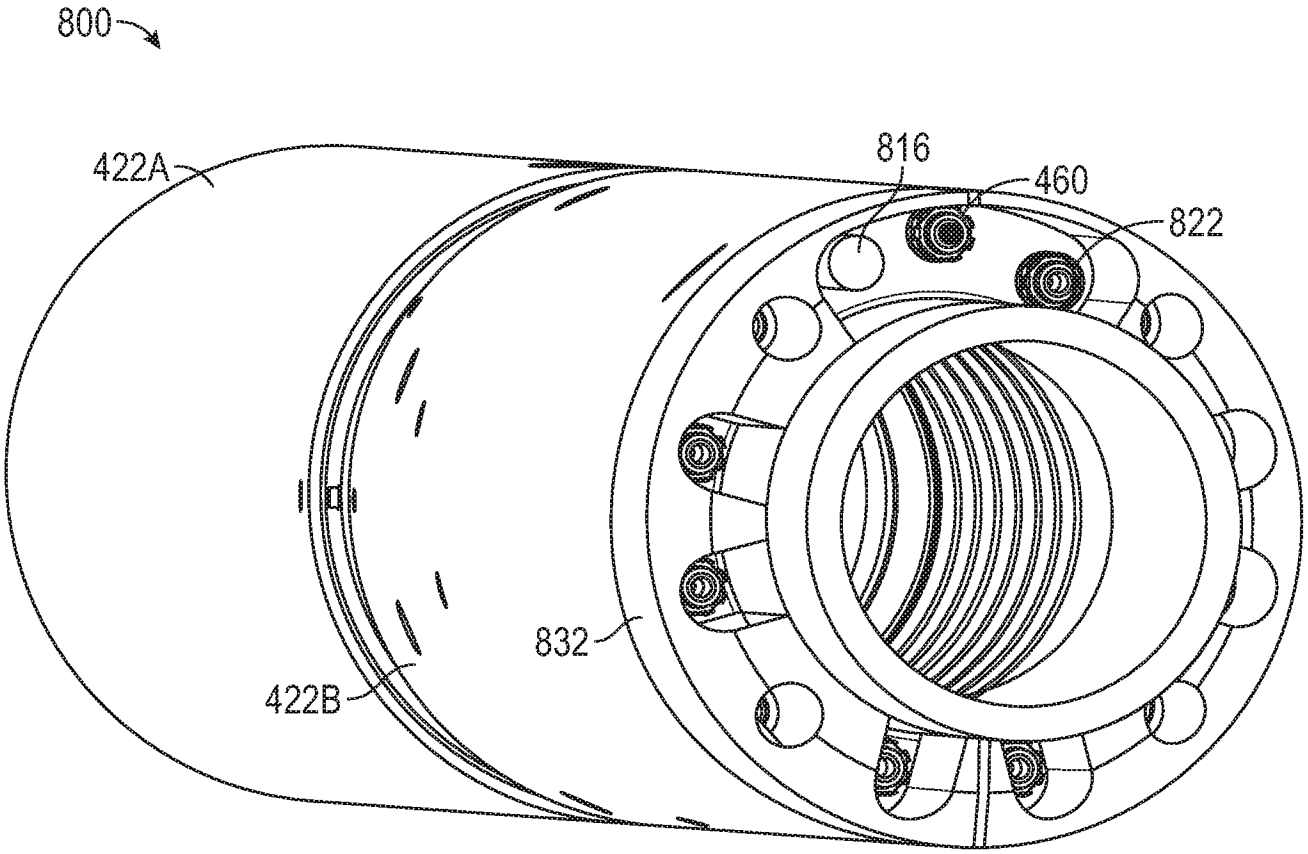
FIG. 8F is a three-dimensional view of this same embodiment, showing a protective housing.

FIG. 8E is another sectional view of the downhole end of EHDT 800, accordingly to another illustrative embodiment of the present disclosure. In this example, a protective housing 832 is positioned around the downhole end of receptacle housing 422B to protect termination fittings 460, 822 and bellows assembly 816. Protective housing 832 may be secured to receptacle housing 422B using any suitable means. FIG. 8F is a three-dimensional view of this same embodiment, showing protective housing 832. Moreover, although not shown, the upper end of EHDT 800 may include another protective housing coupled to male sub housing 402 to protect bellows assembly 802, electrical termination fitting 412, and hydraulic termination fittings 806.

The embodiment of FIGS. 8A-F would once again require filling chambers 418,431 of EHDT 800 with dielectric pressure compensation fluid. In this design, the sizing of the bellows would be critical as the bellows must be able to accommodate the increase in pressure due to the increase in wellbore temperature. Such alterations are within the ability of ordinarily skilled artisans having the benefit of this disclosure.

Accordingly, the embodiments and methods described herein provide EHDTs having high strength metallic components combined with the electrical insulation coating that eliminates the need for elastomeric diaphragms and vacuum filled/sealed pressure compensation systems. This advancement will reduce the complexity, cost, and lead time of the EHDT. In addition, it will increase reliability, profit per tool, and increase market share due to increased reliability and decreased lead times. Further, those embodiments utilizing pressure compensation systems will provide even greater reliability while reducing the complexity and cost associated with conventional pressure compensation system.

Embodiments and methods described herein further relate to any one or more of the following paragraphs:

1. A downhole electrical disconnect tool ("EDT), comprising a female receptacle sub, comprising a receptacle housing having a bore therethrough; a female electrical connector positioned along the receptacle housing; and a metallic receptacle connector band in electrical contact with the female electrical connector, the metallic receptacle connector band having a first coated section overlaid with electrically insulating material; and a second uncoated section providing the electrical contact with the female electrical connector; and a male sub, comprising: a male housing having a bore therethrough; a male electrical connector positioned along the male housing; and a metallic male connector band in electrical contact with the male electrical connector, the metallic male connector band having: a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors.
2. The EDT as defined in paragraph 1, wherein the receptacle connector band further comprises a third coated section overlaid with electrically insulating material, wherein the second uncoated section is positioned between the first and third coated sections of the receptacle connector band; and the male connector band further comprises a third coated section overlaid with electrically insulating material, the third coated section of the male connector band positioned in contact with the third coated section of the receptacle connector band.
3. The EDT as defined in paragraphs 1 or 2, wherein the receptacle connector band and male connector band are comprised of a material having a minimum yield strength range of 80,000 psi to 150,000 psi; and the electrically insulating material is a ceramic, thermosetting plastic, elastomeric or polymeric material.
4. The EDT as defined in any of paragraphs 1-3, further comprising a first port positioned along the male housing, the first port being in fluid communication with a first channel within the male housing; a first chamber that houses the male electrical connector, the first chamber being in fluid communication with the first channel; a first dissolvable plug positioned between the first port and the first channel; and dielectric pressure compensation fluid held inside the first channel and first chamber by the first dissolvable plug.
5. The EDT as defined in any of paragraphs 1-4, further comprising a second port positioned along the receptacle housing, the second port being in fluid communication with a second channel within the receptacle housing; a second chamber that houses the female electrical connector, the second chamber being in fluid communication with the second channel; a second dissolvable plug positioned between the second port and the second channel; and dielectric pressure compensation fluid held inside the second channel and the second chamber by the second dissolvable plug.
6. The EDT as defined in any of paragraphs 1-5, further comprising a first port positioned along the male housing, the first port being in fluid communication with a first channel within the male housing; a first check valve positioned between the first port and the first channel; a second port positioned along the male housing, the second port being in fluid communication with a second channel within the male housing; a second check valve positioned between the second port and the second channel; a first chamber that houses the male electrical connector, the first chamber being in fluid communication with the first channel and the second channel; and dielectric pressure compensation fluid held inside the first channel, second channel and first chamber by the first and second check valves.
7. The EDT as defined in any of paragraphs 1-6, further comprising a third port positioned along the receptacle housing, the third port being in fluid communication with a third channel within the receptacle housing; a third check valve positioned between the third port and the third channel; a fourth port positioned along the receptacle housing, the fourth port being in fluid communication with a fourth channel within the receptacle housing; a fourth check valve positioned between the fourth port and the fourth channel; a second chamber that houses the female electrical connector, the second chamber being in fluid communication with the third channel and the fourth channel; and dielectric pressure compensation fluid held inside the third channel, fourth channel and second chamber by the third and fourth check valves.

8. The EDT as defined in any of paragraphs 1-7, further comprising a first port positioned along the male housing, the first port being in fluid communication with a first channel within the male housing; a first chamber that houses the male electrical connector, the first chamber being in fluid communication with the first channel; a first floating piston positioned within the first channel; and dielectric pressure compensation fluid held inside the first channel and first chamber by the first floating piston.

9. The EDT as defined in any of paragraphs 1-8, further comprising a second port positioned along the receptacle housing, the second port being in fluid communication with a second channel within the receptacle housing; a second chamber that houses the female electrical connector, the second chamber being in fluid communication with the second channel; a second floating piston positioned within the second channel; and dielectric pressure compensation fluid held inside the second channel and the second chamber by the second floating piston.

10. The EDT as defined in any of paragraphs 1-9, wherein at least one of the first and second floating pistons comprise a first bore having a first check valve therein; and a second bore having a second check valve therein.

11. The EDT as defined in any of paragraphs 1-10, further comprising a first port positioned along the male housing, the first port being in fluid communication with a first channel within the male housing; a first chamber that houses the male electrical connector, the first chamber being in fluid communication with the first channel; a first bellows assembly positioned within the first port; and dielectric pressure compensation fluid held inside the first channel and first chamber by the first bellows assembly.

12. The EDT as defined in any of paragraphs 1-11, further comprising a second port positioned along the receptacle housing, the second port being in fluid communication with a second channel within the receptacle housing; a second chamber that houses the female electrical connector, the second chamber being in fluid communication with the second channel; a second bellows assembly positioned within the second port; and dielectric pressure compensation fluid held inside the second channel and the second chamber by the second bellows assembly.

13. A method of manufacturing a downhole electrical disconnect tool ("EDT"), comprising providing a female receptacle sub, comprising a receptacle housing having a bore therethrough; a female electrical connector positioned along the receptacle housing; and a metallic receptacle connector band in electrical contact with the female electrical connector, the metallic receptacle connector band having: a first coated section overlaid with electrically insulating material; and a second uncoated section providing the electrical contact with the female electrical connector; and providing a male sub, comprising a male housing having a bore therethrough; a male electrical connector positioned along the male housing; and a metallic male connector band in electrical contact with the male electrical connector, the metallic male connector band having: a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors.

14. The method as defined in paragraph 13, further comprising providing the receptacle connector band with a third coated section overlaid with electrically insulating material, wherein the second uncoated section is positioned between the first and third coated sections of the receptacle connector band; and providing the male connector band with a third coated section overlaid with electrically insulating material, the third coated section of the male connector band positioned in contact with the third coated section of the receptacle connector band.

15. The method as defined in paragraphs 13 or 14, wherein the receptacle connector band and male connector band are comprised of a material having a minimum yield strength range of 80,000 psi to 150,000 psi; and the electrically insulating material is a ceramic, thermosetting plastic, elastomeric or polymeric material.

16. The method as defined in any of paragraphs 13-15, further comprising providing a first port positioned along the male housing, the first port being in fluid communication with a first channel within the male housing; providing a first chamber that houses the male electrical connector, the first chamber being in fluid communication with the first channel; providing a first dissolvable plug positioned between the first port and the first channel; and providing dielectric pressure compensation fluid held inside the first channel and first chamber by the first dissolvable plug.

17. The method as defined in any of paragraphs 13-16, further comprising providing a second port positioned along the receptacle housing, the second port being in fluid communication with a second channel within the receptacle housing; providing a second chamber that houses the female electrical connector, the second chamber being in fluid communication with the second channel; providing a second dissolvable plug positioned between the second port and the second channel; and providing dielectric pressure compensation fluid held inside the second channel and the second chamber by the second dissolvable plug.

18. The method as defined in any of paragraphs 13-17, further comprising providing a first port positioned along the male housing, the first port being in fluid communication with a first channel within the male housing; providing a first check valve positioned between the first port and the first channel; providing a second port positioned along the male housing, the second port being in fluid communication with a second channel within the male housing; providing a second check valve positioned between the second port and the second channel; providing a first chamber that houses the male electrical connector, the first chamber being in fluid communication with the first channel and the second channel; and providing dielectric pressure compensation fluid held inside the first channel, second channel and first chamber by the first and second check valves.

19. The method as defined in any of paragraphs 13-18, further comprising providing a third port positioned along the receptacle housing, the third port being in fluid communication with a third channel within the receptacle housing; providing a third check valve positioned between the third port and the third channel; providing a fourth port positioned along the receptacle housing, the fourth port being in fluid communication with a fourth channel within the receptacle housing; providing a fourth check valve positioned between the fourth port and the fourth channel; providing a second chamber that houses the female electrical connector, the second chamber being in fluid communication with the third channel and the fourth channel; and providing dielectric pressure compensation fluid held inside the third channel, fourth channel and second chamber by the third and fourth check valves.

20. The method as defined in any of paragraphs 13-19, further comprising providing a first port positioned along the male housing, the first port being in fluid communication with a first channel within the male housing; providing a first chamber that houses the male electrical connector, the first chamber being in fluid communication with the first channel; providing a first floating piston positioned within the first channel; and providing dielectric pressure compensation fluid held inside the first channel and first chamber by the first floating piston.

21. The method as defined in any of paragraphs 13-20, further comprising providing a second port positioned along the receptacle housing, the second port being in fluid communication with a second channel within the receptacle housing; providing a second chamber that houses the female electrical connector, the second chamber being in fluid communication with the second channel; providing a second floating piston positioned within the second channel; and providing dielectric pressure compensation fluid held inside the second channel and the second chamber by the second floating piston.

22. The method as defined in any of paragraphs 13-21, wherein at least one of the first and second floating pistons comprise a first bore having a first check valve therein; and a second bore having a second check valve therein.

23. The method as defined in any of paragraphs 13-22, further comprising providing a first port positioned along the male housing, the first port being in fluid communication with a first channel within the male housing; providing a first chamber that houses the male electrical connector, the first chamber being in fluid communication with the first channel; providing a first bellows assembly positioned within the first port; and providing dielectric pressure compensation fluid held inside the first channel and first chamber by the first bellows assembly.

24. The method as defined in any of paragraphs 13-23, further comprising providing a second port positioned along the receptacle housing, the second port being in fluid communication with a second channel within the receptacle housing; providing a second chamber that houses the female electrical connector, the second chamber being in fluid communication with the second channel; providing a second bellows assembly positioned within the second port; and providing dielectric pressure compensation fluid held inside the second channel and the second chamber by the second bellows assembly.

25. A downhole electrical disconnect tool ("EDT), comprising a female receptacle sub having a metallic receptacle connector band coated with electrical insulating material, wherein a section of the receptacle connector band is uncoated; and a male sub having a metallic male connector band coated with electrical insulating material, wherein a section of the male connector band is uncoated, wherein the uncoated sections of the receptacle and male connector bands mate with one another to establish an electrical connection.

26. The EDT as defined in paragraph 25, wherein the electrically insulating material is a ceramic, thermosetting plastic, elastomeric or polymeric material.

27. The EDT as defined in paragraphs 25 or 26, further comprising a first port positioned along the male sub, the first port being in fluid communication with a first channel within the male sub; a first chamber that houses a male electrical connector, the first chamber being in fluid communication with the first channel; a first dissolvable plug positioned between the first port and the first channel; and dielectric pressure compensation fluid held inside the first channel and first chamber by the first dissolvable plug.

28. The EDT as defined in any of paragraphs 25-27, further comprising a second port positioned along the receptacle sub, the second port being in fluid communication with a second channel within the receptacle sub; a second chamber that houses a female electrical connector, the second chamber being in fluid communication with the second channel; a second dissolvable plug positioned between the second port and the second channel; and dielectric pressure compensation fluid held inside the second channel and the second chamber by the second dissolvable plug.

29. The EDT as defined in any of paragraphs 25-29, further comprising a first port positioned along the male sub, the first port being in fluid communication with a first channel within the male sub; a first check valve positioned between the first port and the first channel; a second port positioned along the male sub, the second port being in fluid communication with a second channel within the male sub; a second check valve positioned between the second port and the second channel; a first chamber that houses a male electrical connector, the first chamber being in fluid communication with the first channel and the second channel; and dielectric pressure compensation fluid held inside the first channel, second channel and first chamber by the first and second check valves.

30. The EDT as defined in any of paragraphs 25-29, further comprising a third port positioned along the receptacle sub, the third port being in fluid communication with a third channel within the receptacle sub; a third check valve positioned between the third port and the third channel; a fourth port positioned along the receptacle sub, the fourth port being in fluid communication with a fourth channel within the receptacle sub; a fourth check valve positioned between the fourth port and the fourth channel; a second chamber that houses a female electrical connector, the second chamber being in fluid communication with the third channel and the fourth channel; and dielectric pressure compensation fluid held inside the third channel, fourth channel and second chamber by the third and fourth check valves.

31. The EDT as defined in any of paragraphs 25-30, further comprising a first port positioned along the male sub, the first port being in fluid communication with a first channel within the male sub; a first chamber that houses a male electrical connector, the first chamber being in fluid communication with the first channel; a first floating piston positioned within the first channel; and dielectric pressure compensation fluid held inside the first channel and first chamber by the first floating piston.

32. The EDT as defined in any of paragraphs 25-31, further comprising a second port positioned along the receptacle sub, the second port being in fluid communication with a second channel within the receptacle sub; a second chamber that houses a female electrical connector, the second chamber being in fluid communication with the second channel; a second floating piston positioned within the second channel; and dielectric pressure compensation fluid held inside the second channel and the second chamber by the second floating piston.

33. The EDT as defined in any of paragraphs 25-32, wherein at least one of the first and second floating pistons comprise a first bore having a first check valve therein; and a second bore having a second check valve therein.

34. The EDT as defined in any of paragraphs 25-33, further comprising a first port positioned along the male sub, the first port being in fluid communication with a first channel within the male sub; a first chamber that houses a male electrical connector, the first chamber being in fluid communication with the first channel; a first bellows assembly positioned within the first port; and dielectric pressure compensation fluid held inside the first channel and first chamber by the first bellows assembly.

35. The EDT as defined in any of paragraphs 25-34, further comprising a second port positioned along the receptacle sub, the second port being in fluid communication with a second channel within the receptacle housing; a second chamber that houses a female electrical connector, the second chamber being in fluid communication with the second channel; a second bellows assembly positioned within the second port; and dielectric pressure compensation fluid held inside the second channel and the second chamber by the second bellows assembly.

Furthermore, any of the illustrative methods described herein may be implemented in conjunction with a system comprising processing circuitry or a non-transitory computer readable medium comprising instructions which, when executed by at least one processor, causes the processor to perform any of the methods described herein.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A downhole electrical disconnect tool ("EDT), comprising:

a female receptacle sub, comprising:

a receptacle housing having a bore therethrough;

a female electrical connector positioned along the receptacle housing; and a metallic receptacle connector band in electrical contact with the female electrical connector, the metallic receptacle connector band having:

a first coated section overlaid with electrically insulating material; and a second uncoated section providing the electrical contact with the female electrical connector; and a male sub, comprising:

a male housing having a bore therethrough;

a male electrical connector positioned along the male housing;

a metallic male connector band in electrical contact with the male electrical connector, the metallic male connector band having:

a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors;

a first port positioned along the male housing, the first port being in fluid communication with a first channel within the male housing;

a first chamber that houses the male electrical connector, the first chamber being in fluid communication with the first channel;

a first dissolvable plug positioned between the first port and the first channel;

dielectric pressure compensation fluid held inside the first channel and first chamber by the first dissolvable plug;

a second port positioned along the receptacle housing, the second port being in fluid communication with a second channel within the receptacle housing;

a second chamber that houses the female electrical connector, the second chamber being in fluid communication with the second channel;

a second dissolvable plug positioned between the second port and the second channel; and dielectric pressure compensation fluid held inside the second channel and the second chamber by the second dissolvable plug.

2. The EDT as defined in claim 1, wherein:

the receptacle connector band further comprises a third coated section overlaid with electrically insulating material, wherein the second uncoated section is positioned between the first and third coated sections of the receptacle connector band; and the male connector band further comprises a third coated section overlaid with electrically insulating material, the third coated section of the male connector band positioned in contact with the third coated section of the receptacle connector band.

3. A downhole electrical disconnect tool ("EDT), comprising:

a female receptacle sub, comprising:

a receptacle housing having a bore therethrough;

a female electrical connector positioned along the receptacle housing; and a metallic receptacle connector band in electrical contact with the female electrical connector, the metallic receptacle connector band having:

a first coated section overlaid with electrically insulating material; and a second uncoated section providing the electrical contact with the female electrical connector;

a male sub, comprising:

a male housing having a bore therethrough;

a male electrical connector positioned along the male housing; and a metallic male connector band in electrical contact with the male electrical connector, the metallic male connector band having:

a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors;

a first port positioned along the male housing, the first port being in fluid communication with a first channel within the male housing;

a first check valve positioned between the first port and the first channel;

a second port positioned along the male housing, the second port being in fluid communication with a second channel within the male housing;

a second check valve positioned between the second port and the second channel;

a first chamber that houses the male electrical connector, the first chamber being in fluid communication with the first channel and the second channel;

dielectric pressure compensation fluid held inside the first channel, second channel and first chamber by the first and second check valves;

a third port positioned along the receptacle housing, the third port being in fluid communication with a third channel within the receptacle housing;

a third check valve positioned between the third port and the third channel;

a fourth port positioned along the receptacle housing, the fourth port being in fluid communication with a fourth channel within the receptacle housing;

a fourth check valve positioned between the fourth port and the fourth channel;

a second chamber that houses the female electrical connector, the second chamber being in fluid communication with the third channel and the fourth channel; and dielectric pressure compensation fluid held inside the third channel, fourth channel and second chamber by the third and fourth check valves.

4. A downhole electrical disconnect tool ("EDT), comprising:

a female receptacle sub, comprising:

a receptacle housing having a bore therethrough;

a female electrical connector positioned along the receptacle housing; and a metallic receptacle connector band in electrical contact with the female electrical connector, the metallic receptacle connector band having:

a first coated section overlaid with electrically insulating material; and a second uncoated section providing the electrical contact with the female electrical connector;

a male sub, comprising:

a male housing having a bore therethrough;

a male electrical connector positioned along the male housing; and a metallic male connector band in electrical contact with the male electrical connector, the metallic male connector band having:

a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors;

a first port positioned along the male housing, the first port being in fluid communication with a first channel within the male housing;

a first chamber that houses the male electrical connector, the first chamber being in fluid communication with the first channel;

a first floating piston positioned within the first channel;

dielectric pressure compensation fluid held inside the first channel and first chamber by the first floating piston;

a second port positioned along the receptacle housing, the second port being in fluid communication with a second channel within the receptacle housing;

a second chamber that houses the female electrical connector, the second chamber being in fluid communication with the second channel;

a second floating piston positioned within the second channel; and dielectric pressure compensation fluid held inside the second channel and the second chamber by the second floating piston.

5. The EDT as defined in claim 4, wherein at least one of the first and second floating pistons comprises:

a first bore having a first check valve therein; and a second bore having a second check valve therein.

6. A downhole electrical disconnect tool ("EDT), comprising:

a female receptacle sub, comprising:

a receptacle housing having a bore therethrough;

a female electrical connector positioned along the receptacle housing; and a metallic receptacle connector band in electrical contact with the female electrical connector, the metallic receptacle connector band having:

a first coated section overlaid with electrically insulating material; and a second uncoated section providing the electrical contact with the female electrical connector;

a male sub, comprising:

a male housing having a bore therethrough;

a male electrical connector positioned along the male housing; and a metallic male connector band in electrical contact with the male electrical connector, the metallic male connector band having:

a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors;

a first port positioned along the male housing, the first port being in fluid communication with a first channel within the male housing;

a first chamber that houses the male electrical connector, the first chamber being in fluid communication with the first channel;

a first bellows assembly positioned within the first port;

dielectric pressure compensation fluid held inside the first channel and first chamber by the first bellows assembly;

a second port positioned along the receptacle housing, the second port being in fluid communication with a second channel within the receptacle housing;

a second chamber that houses the female electrical connector, the second chamber being in fluid communication with the second channel;

a second bellows assembly positioned within the second port; and dielectric pressure compensation fluid held inside the second channel and the second chamber by the second bellows assembly.

7. A method of manufacturing a downhole electrical disconnect tool ("EDT"), comprising:

providing a female receptacle sub, comprising:

a receptacle housing having a bore therethrough;

a female electrical connector positioned along the receptacle housing; and a metallic receptacle connector band in electrical contact with the female electrical connector, the metallic receptacle connector band having:

a first coated section overlaid with electrically insulating material; and a second uncoated section providing the electrical contact with the female electrical connector; and providing a male sub, comprising:

a male housing having a bore therethrough;

a male electrical connector positioned along the male housing;

a metallic male connector band in electrical contact with the male electrical connector, the metallic male connector band having:

a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors;

providing a first port positioned along the male housing, the first port being in fluid communication with a first channel within the male housing;

providing a first chamber that houses the male electrical connector, the first chamber being in fluid communication with the first channel;

providing a first dissolvable plug positioned between the first port and the first channel;

providing dielectric pressure compensation fluid held inside the first channel and first chamber by the first dissolvable plug;

providing a second port positioned along the receptacle housing, the second port being in fluid communication with a second channel within the receptacle housing;

providing a second chamber that houses the female electrical connector, the second chamber being in fluid communication with the second channel;

providing a second dissolvable plug positioned between the second port and the second channel; and providing dielectric pressure compensation fluid held inside the second channel and the second chamber by the second dissolvable plug.

8. The method as defined in claim 7, further comprising:

providing the receptacle connector band with a third coated section overlaid with electrically insulating material, wherein the second uncoated section is positioned between the first and third coated sections of the receptacle connector band; and providing the male connector band with a third coated section overlaid with electrically insulating material, the third coated section of the male connector band positioned in contact with the third coated section of the receptacle connector band.

9. A method of manufacturing a downhole electrical disconnect tool ("EDT"), comprising:

providing a female receptacle sub, comprising:

a receptacle housing having a bore therethrough;

a female electrical connector positioned along the receptacle housing; and a metallic receptacle connector band in electrical contact with the female electrical connector, the metallic receptacle connector band having:

a first coated section overlaid with electrically insulating material; and a second uncoated section providing the electrical contact with the female electrical connector;

providing a male sub, comprising:

a male housing having a bore therethrough;

a male electrical connector positioned along the male housing;

a metallic male connector band in electrical contact with the male electrical connector, the metallic male connector band having:

a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors;

providing a first port positioned along the male housing, the first port being in fluid communication with a first channel within the male housing;

providing a first check valve positioned between the first port and the first channel;

providing a second port positioned along the male housing, the second port being in fluid communication with a second channel within the male housing;

providing a second check valve positioned between the second port and the second channel;

providing a first chamber that houses the male electrical connector, the first chamber being in fluid communication with the first channel and the second channel;

providing dielectric pressure compensation fluid held inside the first channel, second channel and first chamber by the first and second check valves;

providing a third port positioned along the receptacle housing, the third port being in fluid communication with a third channel within the receptacle housing;

providing a third check valve positioned between the third port and the third channel;

providing a fourth port positioned along the receptacle housing, the fourth port being in fluid communication with a fourth channel within the receptacle housing;

providing a fourth check valve positioned between the fourth port and the fourth channel;

providing a second chamber that houses the female electrical connector, the second chamber being in fluid communication with the third channel and the fourth channel; and providing dielectric pressure compensation fluid held inside the third channel, fourth channel and second chamber by the third and fourth check valves.

10. A method of manufacturing a downhole electrical disconnect tool ("EDT"), comprising:

providing a female receptacle sub, comprising:

a receptacle housing having a bore therethrough;

a female electrical connector positioned along the receptacle housing; and a metallic receptacle connector band in electrical contact with the female electrical connector, the metallic receptacle connector band having:

a first coated section overlaid with electrically insulating material; and a second uncoated section providing the electrical contact with the female electrical connector;

providing a male sub, comprising:

a male housing having a bore therethrough;

a male electrical connector positioned along the male housing;

a metallic male connector band in electrical contact with the male electrical connector, the metallic male connector band having:

a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors;

providing a first port positioned along the male housing, the first port being in fluid communication with a first channel within the male housing;

providing a first chamber that houses the male electrical connector, the first chamber being in fluid communication with the first channel;

providing a first floating piston positioned within the first channel;

providing dielectric pressure compensation fluid held inside the first channel and first chamber by the first floating piston;

providing a second port positioned along the receptacle housing, the second port being in fluid communication with a second channel within the receptacle housing;

providing a second chamber that houses the female electrical connector, the second chamber being in fluid communication with the second channel;

providing a second floating piston positioned within the second channel; and providing dielectric pressure compensation fluid held inside the second channel and the second chamber by the second floating piston.

11. The method as defined in claim 10, wherein at least one of the first and second floating pistons comprises:

a first bore having a first check valve therein; and a second bore having a second check valve therein.

12. A method of manufacturing a downhole electrical disconnect tool ("EDT"), comprising:

providing a female receptacle sub, comprising:

a receptacle housing having a bore therethrough;

a female electrical connector positioned along the receptacle housing; and a metallic receptacle connector band in electrical contact with the female electrical connector, the metallic receptacle connector band having:

a first coated section overlaid with electrically insulating material; and a second uncoated section providing the electrical contact with the female electrical connector;

providing a male sub, comprising:

a male housing having a bore therethrough;

a male electrical connector positioned along the male housing;

a metallic male connector band in electrical contact with the male electrical connector, the metallic male connector band having:

a first coated section overlaid with electrically insulating material, the first coated section of the male connector band positioned in contact with the first coated section of the receptacle connector band; and a second uncoated section providing the electrical contact with the male electrical connector, the second uncoated section of the male connector band positioned in contact with the second uncoated section of the receptacle connector band to provide electrical connection between the male and female electrical connectors;

providing a first port positioned along the male housing, the first port being in fluid communication with a first channel within the male housing;

providing a first chamber that houses the male electrical connector, the first chamber being in fluid communication with the first channel;

providing a first bellows assembly positioned within the first port;

providing dielectric pressure compensation fluid held inside the first channel and first chamber by the first bellows assembly;

providing a second port positioned along the receptacle housing, the second port being in fluid communication with a second channel within the receptacle housing;

providing a second chamber that houses the female electrical connector, the second chamber being in fluid communication with the second channel;

providing a second bellows assembly positioned within the second port; and providing dielectric pressure compensation fluid held inside the second channel and the second chamber by the second bellows assembly.

13. A downhole electrical disconnect tool ("EDT), comprising:

a female receptacle sub having a metallic receptacle connector band coated with electrical insulating material, wherein a section of the receptacle connector band is uncoated;

a male sub having a metallic male connector band coated with electrical insulating material, wherein a section of the male connector band is uncoated, wherein the uncoated sections of the receptacle and male connector bands mate with one another to establish an electrical connection;

a first port positioned along the male sub, the first port being in fluid communication with a first channel within the male sub;

a first chamber that houses a male electrical connector, the first chamber being in fluid communication with the first channel;

a first dissolvable plug positioned between the first port and the first channel;

dielectric pressure compensation fluid held inside the first channel and first chamber by the first dissolvable plug;

a second port positioned along the receptacle sub, the second port being in fluid communication with a second channel within the receptacle sub;

a second chamber that houses a female electrical connector, the second chamber being in fluid communication with the second channel;

a second dissolvable plug positioned between the second port and the second channel; and dielectric pressure compensation fluid held inside the second channel and the second chamber by the second dissolvable plug.

14. A downhole electrical disconnect tool ("EDT), comprising:

a female receptacle sub having a metallic receptacle connector band coated with electrical insulating material, wherein a section of the receptacle connector band is uncoated;

a male sub having a metallic male connector band coated with electrical insulating material, wherein a section of the male connector band is uncoated, wherein the uncoated sections of the receptacle and male connector bands mate with one another to establish an electrical connection;

a first port positioned along the male sub, the first port being in fluid communication with a first channel within the male sub;

a first check valve positioned between the first port and the first channel;

a second port positioned along the male sub, the second port being in fluid communication with a second channel within the male sub;

a second check valve positioned between the second port and the second channel;

a first chamber that houses a male electrical connector, the first chamber being in fluid communication with the first channel and the second channel;

dielectric pressure compensation fluid held inside the first channel, second channel and first chamber by the first and second check valves;

a third port positioned along the receptacle sub, the third port being in fluid communication with a third channel within the receptacle sub;

a third check valve positioned between the third port and the third channel;

a fourth port positioned along the receptacle sub, the fourth port being in fluid communication with a fourth channel within the receptacle sub;

a fourth check valve positioned between the fourth port and the fourth channel;

a second chamber that houses a female electrical connector, the second chamber being in fluid communication with the third channel and the fourth channel; and dielectric pressure compensation fluid held inside the third channel, fourth channel and second chamber by the third and fourth check valves.

15. A downhole electrical disconnect tool ("EDT), comprising:

a female receptacle sub having a metallic receptacle connector band coated with electrical insulating material, wherein a section of the receptacle connector band is uncoated;

a male sub having a metallic male connector band coated with electrical insulating material, wherein a section of the male connector band is uncoated, wherein the uncoated sections of the receptacle and male connector bands mate with one another to establish an electrical connection;

a first port positioned along the male sub, the first port being in fluid communication with a first channel within the male sub;

a first chamber that houses a male electrical connector, the first chamber being in fluid communication with the first channel;

a first floating piston positioned within the first channel;

dielectric pressure compensation fluid held inside the first channel and first chamber by the first floating piston;

a second port positioned along the receptacle sub, the second port being in fluid communication with a second channel within the receptacle sub;

a second chamber that houses a female electrical connector, the second chamber being in fluid communication with the second channel;

a second floating piston positioned within the second channel; and dielectric pressure compensation fluid held inside the second channel and the second chamber by the second floating piston.

16. The EDT as defined in claim 15, wherein at least one of the first and second floating pistons comprises:

a first bore having a first check valve therein; and a second bore having a second check valve therein.

17. A downhole electrical disconnect tool ("EDT), comprising:

a female receptacle sub having a metallic receptacle connector band coated with electrical insulating material, wherein a section of the receptacle connector band is uncoated;

a male sub having a metallic male connector band coated with electrical insulating material, wherein a section of the male connector band is uncoated, wherein the uncoated sections of the receptacle and male connector bands mate with one another to establish an electrical connection;

a first port positioned along the male sub, the first port being in fluid communication with a first channel within the male sub;

a first chamber that houses a male electrical connector, the first chamber being in fluid communication with the first channel;

a first bellows assembly positioned within the first port;

dielectric pressure compensation fluid held inside the first channel and first chamber by the first bellows assembly;

a second port positioned along the receptacle sub, the second port being in fluid communication with a second channel within the receptacle housing;

a second chamber that houses a female electrical connector, the second chamber being in fluid communication with the second channel;

a second bellows assembly positioned within the second port; and dielectric pressure compensation fluid held inside the second channel and the second chamber by the second bellows assembly.

* * * * *